US005647333A

United States Patent [19]

Mukai

[11] Patent Number: 5,647,333

[45] Date of Patent: Jul. 15, 1997

[54] EVAPORATIVE FUEL CONTROL SYSTEM FOR AN INTERNAL COMBUSTION ENGINE

[75] Inventor: Takeshi Mukai, Hamamatsu, Japan

[73] Assignee: Suzuki Motor Corporation, Hamamatsu, Japan

[21] Appl. No.: 601,691

[22] Filed: Feb. 15, 1996

[30] Foreign Application Priority Data

Feb. 22, 1995 [JP] Japan ..... 7-058137

[51] Int. Cl.[6] ..... F02M 33/04

[52] U.S. Cl. ..... 123/519; 123/520

[58] Field of Search ..... 123/516, 518, 123/519, 520

[56] References Cited

U.S. PATENT DOCUMENTS 4,446,838 5/1984 Suzuki et al. ..... 123/520

5,193,512 3/1993 Steinbrenner et al. ..... 123/520

5,377,644 1/1995 Krohm ..... 123/520

5,398,660 3/1995 Koyama et al. ..... 123/520

5,427,076 6/1995 Kobayashi et al. ..... 123/520

*Primary Examiner*—Thomas N. Moulis

*Attorney, Agent, or Firm*—Bell, Seltzer, Park & Gibson

[57] ABSTRACT

During the stoppage of an internal combustion engine or the refueling of a fuel tank, evaporative fuel is collected in a canister, and then only the air contained in the evaporative fuel is discharged into the atmosphere. To achieve this, the canister is provided with a plurality of atmosphere communication lines communicating with the atmosphere side, an air cut valve is installed respectively in each of these atmosphere communication lines, and control means for controlling the operation of the air cut valves is provided.

10 Claims, 17 Drawing Sheets

EVAPORATIVE FUEL CONTROL SYSTEM FOR AN INTERNAL COMBUSTION ENGINE

FIELD OF THE INVENTION AND RELATED ART STATEMENT

The present invention relates to an evaporative fuel control system for an internal combustion engine and, more particularly, to an evaporative fuel control system for an internal combustion engine, which is capable of preventing evaporative fuel from being discharged into the atmosphere during the stoppage of internal combustion engine or during the refueling of a fuel tank.

For a vehicle, evaporative fuel leaking from a fuel tank or the like into the atmosphere, containing a large amount of hydrocarbon (HC), is one of the causes for air pollution, and also leads to a loss of fuel. To solve this problem, various kinds of techniques have been proposed. A typical technique is an evaporative fuel control system (evaporation system) in which evaporative fuel from a fuel tank is purged from a canister containing an adsorbent such as activated charcoal and supplied to an internal combustion engine during the operation of internal combustion engine.

In this evaporative fuel control system, as shown in FIG. 22, a canister 516 is provided between an evaporation line 504 communicating with a fuel tank 502 and a purge line 512 which is an intake system for an internal combustion engine 506 and in communication with an intake passage 510 on the downstream side of a throttle valve 508. The canister 516 adsorbs evaporative fuel, which is generated in the fuel tank 502 and introduced to the evaporation line 504 during the stoppage of the internal combustion engine 506, and purges the adsorbed evaporative fuel by means of air introduced from an atmosphere communication line 514 to supply it to the intake passage 510 through the purge line 512 during the operation of the internal combustion engine 506. At an intermediate position of the purge line 512 is installed a purge valve (two-way solenoid valve) 518 for controlling the amount of evaporative fuel supplied to the intake passage 510 in accordance with the operation state of the internal combustion engine 506. The purge valve 518 undergoes duty control by using a control section (ECM) (not shown).

The fuel tank 502 is provided with a fuel oil pipe 522 for pouring fuel from a fuel oil gun 520. Also, the fuel tank 502 has a breather pipe 524 for connecting the upper part of the fuel tank 502 to the intermediate position of the fuel oil pipe 522.

Other evaporative fuel control systems of this type disclosed, for example, in Japanese Patent Provisional Publication No. 6-17712 (No. 17712/1994) and Japanese Patent Provisional Publication No. 6-17713 (No. 17713/1994) are known. The evaporative fuel control system disclosed in Japanese Patent Provisional Publication No. 6-17712 (No. 17712/1994) is constituted as follows: A pressure control valve is installed in a first line, a first solenoid valve is installed in a second line, a communication line is provided to connect an intake passage to the pressure control valve, and a second solenoid valve is installed in the communication line, so that a negative pressure in intake pipe is applied by the operation of the second solenoid valve to open the pressure control valve during the operation of an internal combustion engine. Also, a control section is provided to carry out control so that the second solenoid valve is operated by a detection signal from a fuel level gage to apply air to the pressure control valve when the amount of fuel in a fuel tank exceeds a predetermined amount. This makes the tank pressure substantially equal to the atmospheric pressure so that the tank pressure is not discharged to the atmosphere during refueling, and prevents overfilling of fuel during refueling. The evaporative fuel control system disclosed in Japanese Patent Provisional Publication No. 6-17713 (No. 17713/1994) is constituted as follows: An air line one end of which is connected to an intake passage and the other end of which is connected to a fuel tank by branching into a first branch air line and a second branch air line is provided, a canister for adsorbing evaporative fuel is installed in the air line, a switching valve is installed between the canister and the intake passage, a check valve, which opens when the pressure in a fuel tank reaches a predetermined pressure, is installed in the first branch air line, a control valve, which is opened during the operation of an internal combustion engine, is installed in the second air liner and a float valve, which is closed when the fuel tank is full, is installed at the opening of the first branch air line in the fuel tank. This makes the tank pressure substantially equal to the atmospheric pressure so that the tank pressure is not discharged to the atmosphere during refueling, and prevents overfilling of fuel even if fuel oil is fed during the operation of an internal combustion engine.

In the evaporative fuel control system shown in FIG. 22, however, the evaporative fuel generated in the fuel tank 502 is discharged into the atmosphere through the breather pipe 524 at the refueling time when fuel is poured into the fuel tank 502, resulting in air pollution.

Also, in the evaporative fuel control systems described in the above-described Publications, a large amount of evaporative fuel is generated in the fuel tank in refueling, so that it is difficult to recover all of the evaporative fuel. Therefore, part of the evaporative fuel generated in the fuel tank may be discharged into the atmosphere.

OBJECT AND SUMMARY OF THE INVENTION

The present invention was made to solve the above problems. Accordingly, the primary object of the present invention is to prevent evaporative fuel generated in a fuel tank from being discharged through a breather pipe at the refueling time when fuel is poured into the fuel tank, and consequently prevent air pollution.

Another object of the present invention is to prevent clogging due to sewage or freezing on the atmosphere side of canister.

Still another object of the present invention is to prevent the contamination of atmosphere communication line or the clogging of canister due to suction air during the operation of internal combustion engine.

In other words, an object of the present invention is to discharge only the air contained in evaporative fuel into the atmosphere after the evaporative fuel is collected in the canister when the internal combustion engine is stopped or when fuel oil is fed into the fuel tank, and to prevent the clogging of canister and the like.

To achieve the above objects, the present invention provides an evaporative fuel control system for an internal combustion engine comprising a canister, installed between an evaporation line communicating with a fuel tank and a purge line communicating with an intake passage of the intake system of the internal combustion engine, for adsorbing an evaporative fuel generated in the fuel tank during the stoppage of the internal combustion engine and introduced to the evaporation line, and for purging the adsorbed evaporative fuel by the introduction of air to supply the evaporative fuel to the intake passage through the purge line during the operation of the internal combustion engine; and a purge valve, installed at the intermediate position of the purge line, for controlling the amount of evaporative fuel supplied to the intake passage in accordance with the operation state of the internal combustion engine, in which the canister is provided with a plurality of atmosphere communication lines communicating with the atmosphere side, an air cut valve is installed in each of the atmosphere communication lines, and control means for controlling the operation of the air cut valve is provided.

In a preferred embodiment of the present invention, the control means controls the operation of one of the air cut valves installed in one of the atmosphere communication lines for introducing air from the canister into the atmosphere, and controls the operation of the other of the air cut valves installed in the other of the atmosphere communication lines for introducing air into the canister.

Also, in a preferred embodiment of the present invention, the diameter of one of the atmosphere communication lines for introducing air from the canister into the atmosphere is larger than the diameter of the other of the atmosphere communication lines for introducing air into the canister.

Further, in a preferred embodiment of the present invention, the tip end of one of the atmosphere communication lines for introducing air from the canister into the atmosphere is connected to a different place so as to introduce the air to a safe place during the refueling of the fuel tank.

Still further, in a preferred embodiment of the present invention, the opening/closing timing of one of the air cut valves operating to discharge air from the canister into the atmosphere and the other of the air cut valves operating to introduce air into the canister is made different.

Also, the present invention provides an evaporative fuel control system for an internal combustion engine comprising a canister, installed between an evaporation line communicating with a fuel tank and a purge line communicating with an intake passage of the intake system of the internal combustion engine, for adsorbing an evaporative fuel generated in the fuel tank during the stoppage of the internal combustion engine and introduced to the evaporation line, and for purging the adsorbed evaporative fuel by the introduction of air to supply the evaporative fuel to the intake passage through the purge line during the operation of the internal combustion engine; and a purge valve, installed at the intermediate position of the purge line, for controlling the amount of evaporative fuel supplied to the intake passage in accordance with the operation state of the internal combustion engine, in which one atmosphere communication line is provided so as to communicate with the canister, a plurality of air cut valves are installed in series in the atmosphere communication line, and control means is provided to control the operation of one of the air cut valves on the canister side so as to open and close the atmosphere communication line and to control the operation of the other of the air cut valves separated from the canister so as to discharge air from the canister into the atmosphere and introduce air into the canister.

According to the configuration of the present invention, the atmosphere communication lines on the atmosphere side of the canister can be opened and closed arbitrarily and selectively during the stoppage of the internal combustion engine, during the refueling of the fuel tank, and during the operation of the internal combustion engine, so that evaporative fuel is collected in the canister and then only the air contained in the evaporative fuel is discharged into the atmosphere during the stoppage of the internal combustion engine or during the refueling of the fuel tank, by which air pollution is prevented, and the clogging due to sewage or freezing on the atmosphere side of the canister can be prevented. Further, the contamination of the atmosphere communication line and the clogging of the canister due to suction air can be prevented during the operation of the internal combustion engine.

DETAILED DESCRIPTION OF PREFERRED EMBODIMENT

The embodiments of the present invention will be described in detail and specifically below with reference to the drawings.

Figure 1:
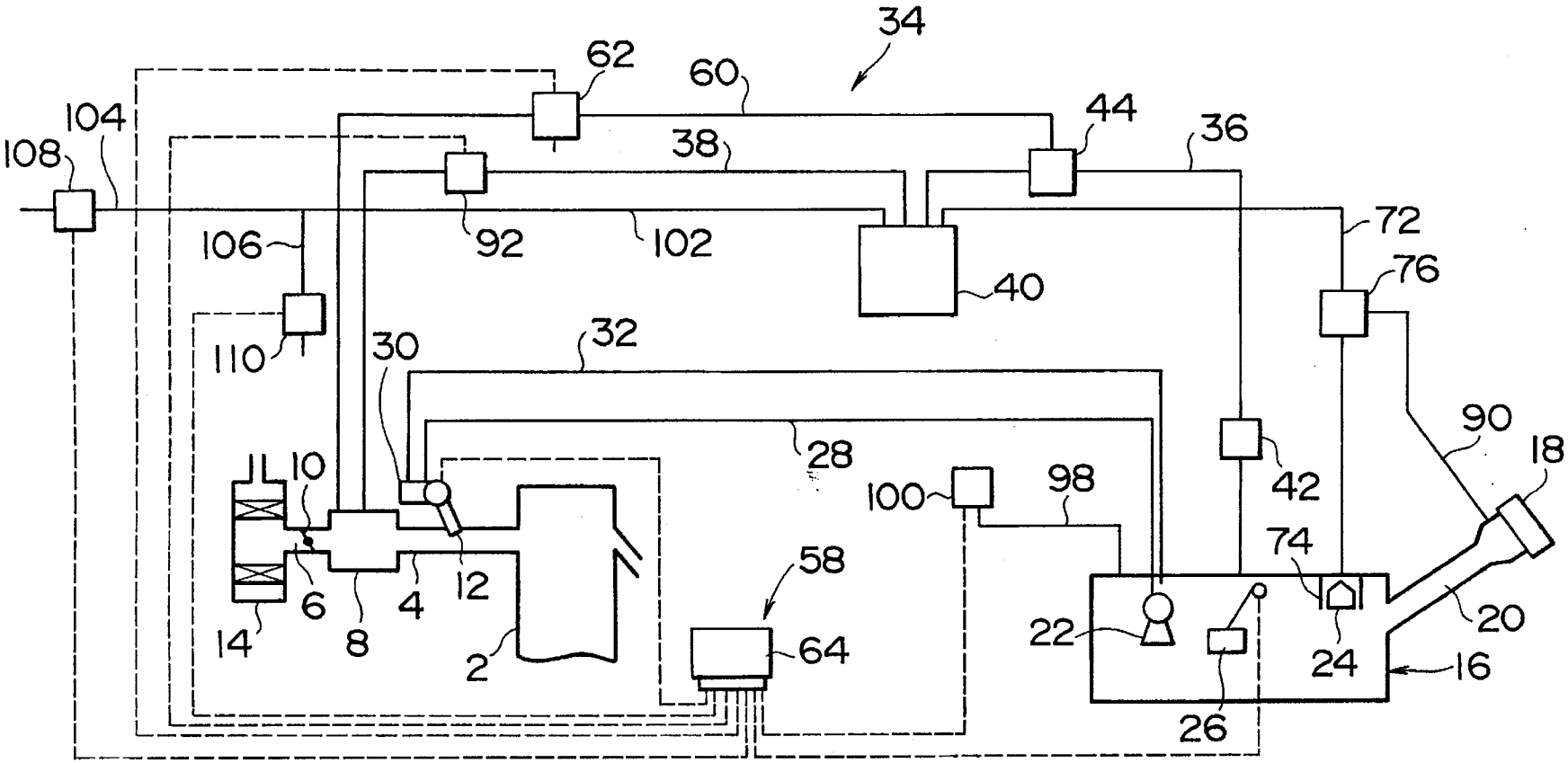
FIG. 1 is a schematic view of an evaporative fuel control system in accordance with a first embodiment of the present invention.

FIGS. 1 to 9 show a first embodiment of the present invention. In FIG. 1, reference numeral 2 denotes an internal combustion engine, 4 denotes an intake manifold, 6 denotes an intake passage, 8 denotes a surge tank, 10 denotes a throttle valve, 12 denotes a fuel injection valve, 14 denotes an air cleaner, and 16 denotes a fuel tank. To the fuel tank 16 is connected a fuel oil pipe 20 having a fuel oil cap 18. In the fuel tank 16 are provided a fuel pump 22, a float valve 24 moving vertically in accordance with the amount of fuel contained in the fuel tank 16, and a level gage 26 for detecting the amount of fuel. One end of a fuel supply line 28 is connected to the fuel pump 22. The other end of the fuel supply line 28 is connected to the fuel injection valve 12. The fuel injection valve 12 is provided with a fuel pressure regulating valve 30. One end of a fuel return line 32 is connected to the fuel pressure regulating valve 30. The other end of the fuel return line 32 is open to the upper part of the fuel tank 16.

An evaporative fuel control system (evaporation system) 34 is provided between the fuel tank 16 and the intake system of the internal combustion engine 2.

Figure 2:
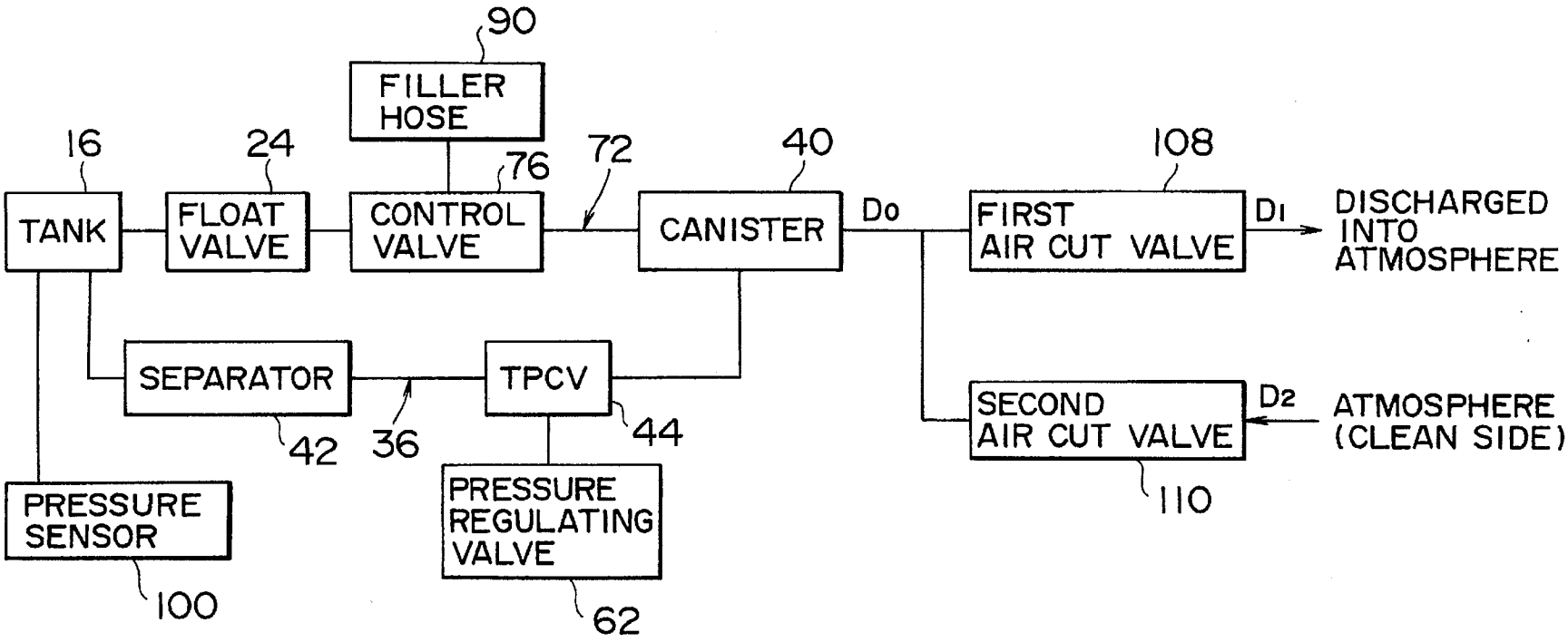
FIG. 2 is a block diagram of an evaporative fuel control system in accordance with a first embodiment of the present invention.

In the evaporative fuel control system 34, as shown in FIGS. 1 and 2, a canister 40 is installed between one end of an evaporation line 36 the other end of which is connected to the fuel tank 16 and one end of a purge line 38 the other end of which is connected to the surge tank 8 constituting the intake passage 6. One end of the evaporation line 36 and one end of the purge line 38 are open, side by side, to the upper part of the canister 40.

The canister 40 adsorbs the evaporative fuel generated in the fuel tank 16 and introduced into the evaporation line 36 during the stoppage of the internal combustion engine 2, and purges the adsorbed evaporative fuel by the introduction of air to supply the evaporative fuel to the intake passage 6 through the purge line 38 during the operation of the internal combustion engine 2.

At the intermediate position of the evaporation line 36, a separator 42 and a tank pressure control valve (TPCV) 44, which is opened so as to open the evaporation line 36 when the tank pressure in the fuel tank 16 reaches a predetermined set pressure during the stoppage of the internal combustion engine 2, are provided in that order from the fuel tank 16 side.

Figure 3:
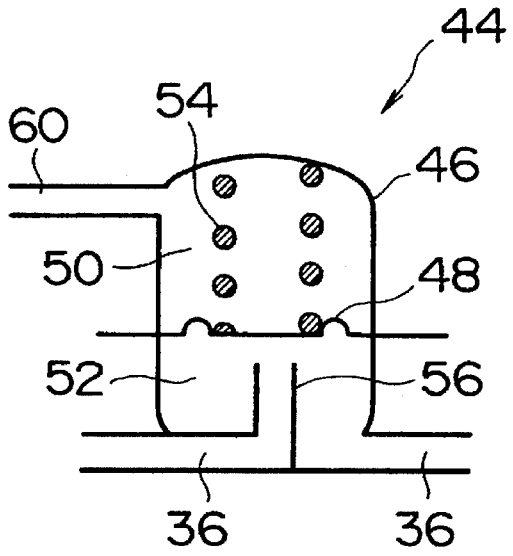
FIG. 3 is a schematic view of a tank pressure control valve.

The tank pressure control valve 44, as shown in FIG. 3, has a first chamber 50 and a second chamber 52 divided by a first diaphragm 48 disposed in a first valve housing 46. The first chamber 50 is furnished with a first spring 54 for applying a predetermined urging force to the first diaphragm 48. The second chamber 52 is furnished with a first valve seat 56 for opening/closing the evaporation line 36 by the separation/contact of the first diaphragm 48.

Figure 5:
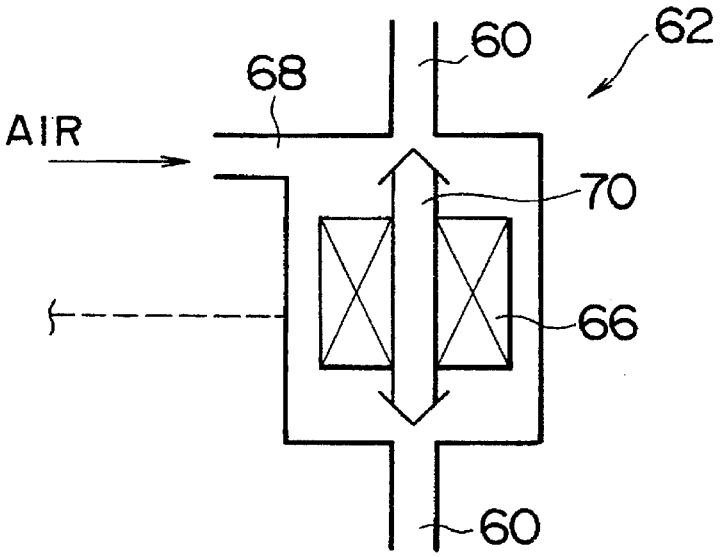
FIG. 5 is a schematic view of a pressure regulating valve.

The tank pressure control valve 44 is also opened/closed by a control means 58 (see FIG. 1) during the operation of the internal combustion engine 2. That is to say, one end of a pressure line 60 is connected to the first chamber 50 of the tank pressure control valve 44. The other end of the pressure line 60 is connected to the surge tank 8. At the intermediate position of the pressure line 60 is installed a pressure regulating valve (three-way solenoid valve) 62. The pressure regulating valve 62 is on-off operated by the duty control carried out by a control section (ECM) 64 to apply air from the pressure line 60 to the first chamber 50 of the tank pressure control valve 44 or to apply an intake pipe negative pressure in the surge tank 8 to the first chamber 50 of the tank pressure control valve 44. Accordingly, as shown in FIG. 5, the pressure regulating valve 62 comprises a first solenoid 66 and a first valve element 70 which reciprocates so as to open/close the pressure line 60 and introduces air through air port 68.

A communication line 72 is provided between the fuel tank 16 and the canister 40 to connect the fuel tank 16 to the canister 40.

The communication line 72 is connected to a float guide member 74 so as to be opened/closed by the float valve 24 moving vertically by being guided in the float guide member 74 in the fuel tank 16.

Figure 4:
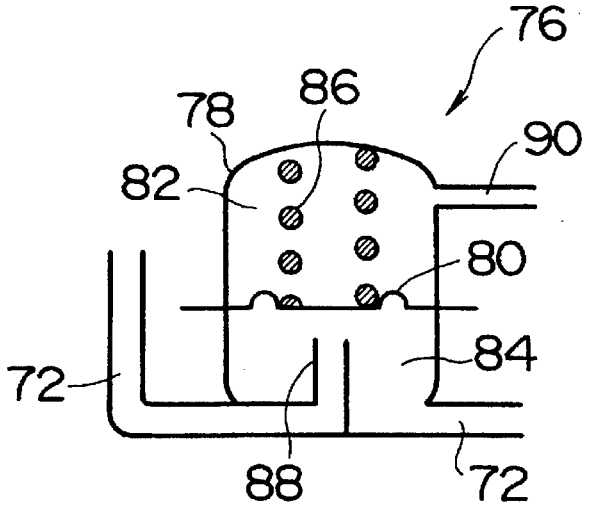
FIG. 4 is a schematic view of a control valve.

At the intermediate position of the communication line 72, a control valve 76, which is, for example, installed to the fuel tank 16 in association with the float valve 24, is provided. The control valve 76, as shown in FIG. 4, has a first chamber 82 and a second chamber 84 divided by a second diaphragm 80 disposed in a second valve housing 78. The first chamber 82 is furnished with a second spring 86 for applying a predetermined urging force to the second diaphragm 80. The second chamber 84 is furnished with a second valve seat 88 for opening/closing the evaporation line 36 by the separation/contact of the second diaphragm 80.

The control valve 76 is provided with a tank line 90 for connecting the first chamber 82 to the fuel oil pipe 20 for the fuel tank 16.

Figure 6:
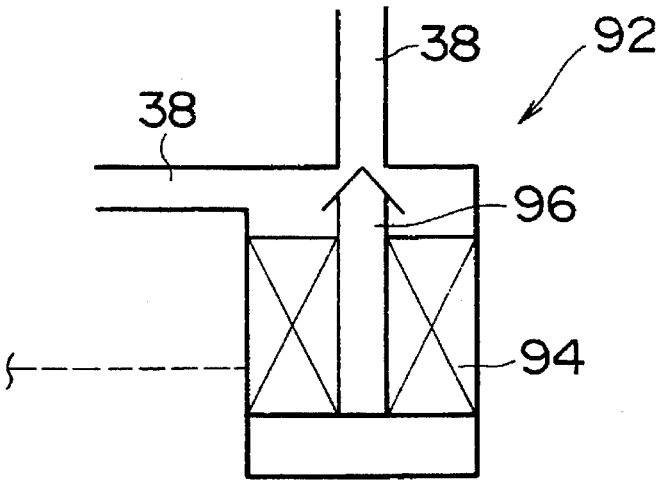
FIG. 6 is a schematic view of a purge valve.

At the intermediate position of the purge line 38, a purge valve (two-way solenoid valve) 92 is installed to control the amount of evaporative fuel supplied to the intake passage 6 in accordance with the operation state of the internal combustion engine 2. As shown in FIG. 6, the purge valve 92 comprises a second solenoid 94 and a second valve element 96 reciprocating so as to open/close the purge line 38. The purge valve 92 is opened/closed by the duty control carried out by the control section 64.

One end of a detection pressure line 98 is connected to the fuel tank 16. The other end of the detection pressure line 98 is connected to a pressure sensor 100 for detecting the tank pressure in the fuel tank 16.

The canister 40 is provided with a plurality of atmosphere communication lines communicating with the atmosphere. An air cut valve is installed to open/close each of these atmosphere communication lines. One end of a main atmosphere communication line 102 is connected to the canister 40. The other end of the main atmosphere communication line 102 branches into a first branch atmosphere communication line 104 and a second atmosphere communication line 106.

Figure 7:
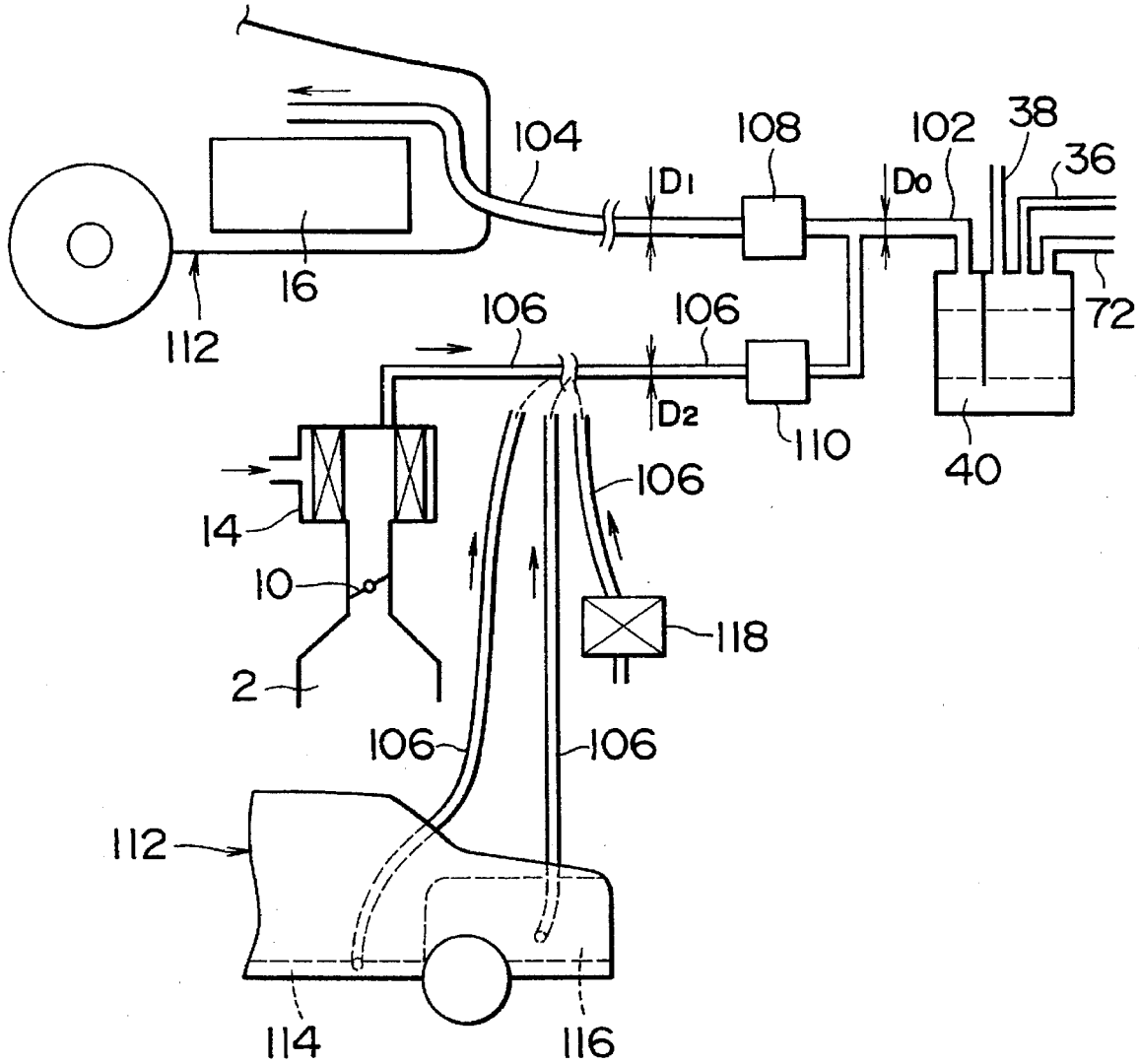
FIG. 7 is a schematic view of the atmosphere side of a canister.
Figure 8:
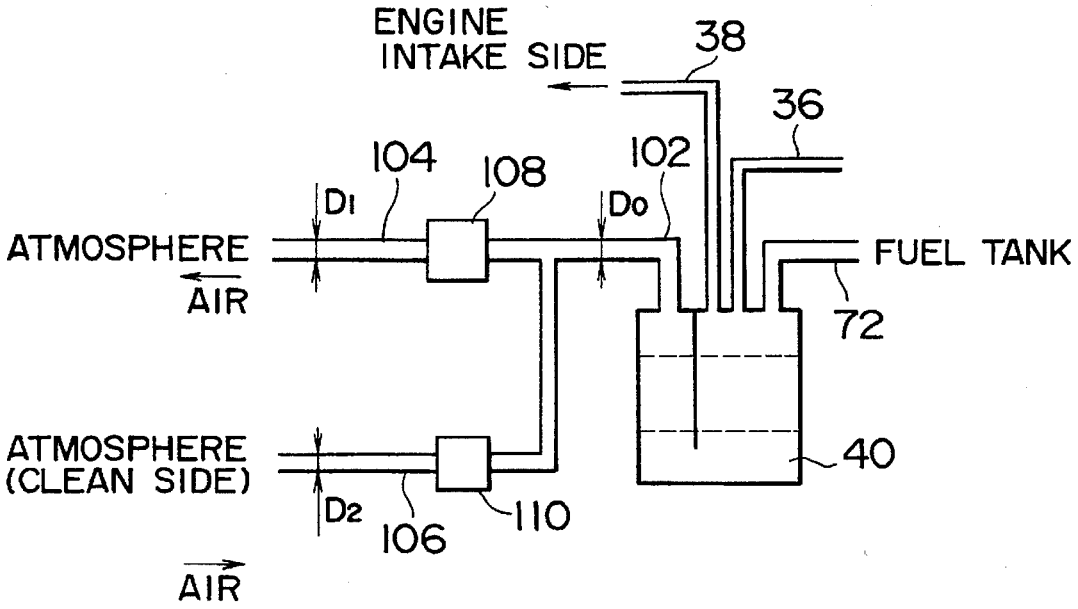
FIG. 8 is an enlarged schematic view of the main part of the atmosphere side of a canister shown in FIG. 7.

As shown in FIGS. 7 and 8, the main atmosphere communication line 102 is formed so as to have a predetermined main diameter $D_0$.

A first diameter $D_1$ of the first branch atmosphere communication line 104 is approximately equal to the diameter $D_0$ of the main atmosphere communication line 102, and is larger than a second diameter $D_2$ of the second branch atmosphere communication line 106.

The first branch atmosphere communication line 104 is provided with a first air cut valve 108 which opens/closes so as to discharge air from the canister 40 into the atmosphere.

The second branch atmosphere communication line 106 is provided with a second air cut valve 110 which opens/closes so as to introduce air into the canister 40.

These first and second air cut valves 108 and 110 have the same configuration as that of the purge valve 92; therefore, the explanation of the configuration is omitted.

As shown in FIG. 7, the other end of the first branch atmosphere communication line 104 is positioned above the fuel tank 16 mounted on a vehicle 112 so as to discharge the air supplied from the canister 40 to a safe place.

The other end of the second branch atmosphere communication line 106 is positioned at a different place, any one of, for example, the air cleaner 14, a frame 114 of the vehicle 112, a trunk 116 of the vehicle 112, and an air filter 118 installed on the vehicle 112, selectively.

The fuel injection valve 12, the level gage 26, the pressure regulating valve 62, the purge valve 92, the pressure sensor 100, and the first and second air cut valves 108 and 110 are connected to the control section 64.

The control section 64, receiving a signal from the level gage 26, the pressure sensor 100, or the like, operates the tank pressure control valve 44 via the pressure regulating valve 62 so as to open/close the evaporation line 36 during the operation of the internal combustion engine 2, and controls the amount of fuel injected into the internal combustion engine 2 by operating the fuel injection valve 12. Also, the control section 64 controls the amount of evaporative fuel supplied to the intake passage 6 by operating the purge valve 92, and in turn opening/closing the purge line 38, and moreover opens/closes the first and second branch atmosphere communication lines 104 and 106 by operating the first and second air cut valves 108 and 110, respectively.

Figure 9:
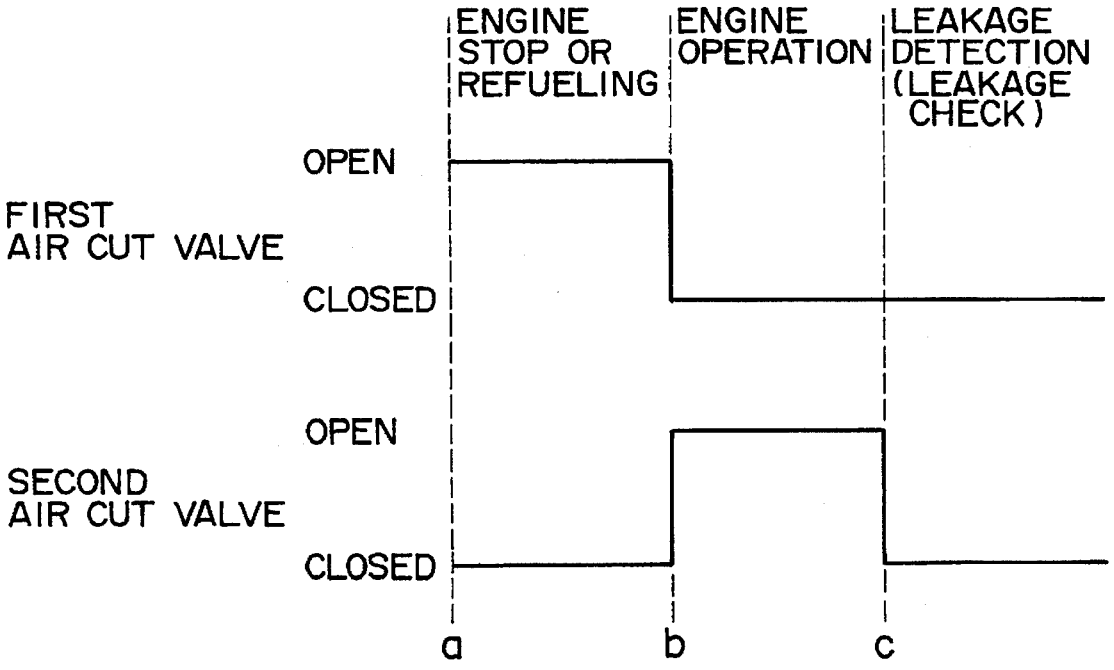
FIG. 9 is a time chart for evaporative fuel control in accordance with the first embodiment.

Further, as shown in FIG. 9, the control section 64 makes different the opening/closing timing of the first and second air cut valves 108 and 110 during the operation of the internal combustion engine 2.

Next, the operation of the first embodiment will be described with reference to the time chart shown in FIG. 9.

When the internal combustion engine 2 is stopped, as shown by a to b in FIG. 9, the operation of the tank pressure control valve 44 depends on the tank pressure in the fuel tank 16, the pressure regulating valve 62 is turned off so as to introduce air into the first chamber 50 of the tank pressure control valve 44 in order to close only the pressure line 60 on the surge tank 8 side, the first air cut valve 108 is opened and the second air cut valve 110 is closed, and the float valve 24 opens the communication line 72. Thereupon, in the tank pressure control valve 44, the first diaphragm 48 is brought into contact with the first valve seat 56 by the urging force of the first spring 54, so that the evaporation line 36 is opened. In such a case, for example, when the tank pressure in the fuel tank 16 reaches the predetermined set pressure, the tank pressure control valve 44 is opened temporarily, so that the evaporation line 36 is opened. As a result, the evaporative fuel generated in the fuel tank 16 flows to the canister 40 side, and is collected in the canister 40, and only the air contained in the evaporative fuel is discharged through the first branch atmosphere communication line 104; moreover, the tank pressure in the fuel tank 16 can be reduced.

When fuel oil is fed into the fuel tank 16, as shown by a to b in FIG. 9, the operation of the tank pressure control valve 44 depends on the tank pressure in the fuel tank 16, the pressure regulating valve 62 is turned off so as to introduce air into the first chamber 50 of the tank pressure control valve 44 in order to close only the pressure line 60 on the surge tank 8 side, the first air cut valve 108 is opened and the second air cut valve 110 is closed, and the float valve 24 opens the communication line 72. When fuel oil is poured into the fuel oil pipe 20 by means of a fuel oil gun (not shown), the tank pressure in the fuel tank 16 becomes higher than the predetermined set pressure. This high tank pressure opens the tank pressure control valve 44, and in turn, the evaporation line 36. Therefore, the evaporative fuel generated in the fuel tank 16 flows smoothly to the canister 40 side through the evaporation line 36 with a large diameter and is collected in the canister 40. Only the air contained in the evaporative fuel is discharged into the atmosphere through the first branch atmosphere communication line 104.

When the internal combustion engine 2 is operated, the first air cut valve 108 is closed, and the second air cut valve 110 is opened (shown by b to c in FIG. 9).

During the operation of the internal combustion engine 2, the control section 64 turns on the pressure regulating valve 62 by duty control to apply a negative pressure in intake pipe to the first chamber 50 of the tank pressure control valve 44. Accordingly, the tank pressure control valve 44 is opened to allow the evaporative fuel to flow to the canister 40 side. The control section 64 also opens the purge valve 92 by duty control. Thereby, air is introduced through the second branch atmosphere communication line 106. The introduced air purges the evaporative fuel in the canister 40, and supplies the evaporative fuel to the intake passage 6 through the purge line 38.

That is to say, during the operation of the internal combustion engine 2, since only the second branch atmosphere communication line 106 is opened, the air supplied from any one of the air cleaner 14, the frame 114, the trunk 116, and the air filter 118 is introduced into the canister 40 through the second branch atmosphere communication line 106 and the main atmosphere communication line 102, by which the evaporative fuel in the canister 40 is purged and supplied to the intake passage 6 through the purge line.

When the leakage of evaporative fuel from the evaporative fuel control system 34 is checked, the first and second air cut valves 108 and 110 are closed (shown by c and after in FIG. 9).

As a result, when the internal combustion engine 2 is stopped or when fuel oil is fed into the fuel tank 16, the evaporative fuel generated in the fuel tank is collected in the caster 40, and only the air contained in the evaporative fuel is discharged into the atmosphere, so that air pollution can be prevented.

Also, when the internal combustion engine 2 is stopped and when fuel oil is fed into the fuel tank 16, since the first and second branch atmosphere communication lines 104 and 106 can be connected to the main atmosphere communication line 102 by switching, the clogging of the caster 40 due to sewage, freezing, etc. and the contamination of the first and second branch atmosphere communication lines 104 and 106 and the main atmosphere communication line 102 due to suction air during the operation of the internal combustion engine 2 can be prevented. Further, the accumulation of dirt and dust in the canister 40 can be prevented.

Since the other end of the first branch atmosphere communication line 104 is positioned above the fuel tank 16, the air from the canister 40 side can be discharged to a safe place during refueling.

During the operation of the internal combustion engine 2, since the opening/closing timing of the first and second air cut valves 108 and 110 is made different, the discharge of air from the canister 40 and the introduction of air to the canister 40 can be performed smoothly.

If the fuel tank 16 becomes full of fuel, the float valve 24 opens the communication line 72, and the tank pressure is controlled by the tank pressure control valve 44, so that the overfilling of fuel can be prevented.

In the evaporative fuel control system 34 of this first embodiment, the normal evaporation control can be carried out properly during the operation of the internal combustion engine 2, and also the regulation for preventing evaporative fuel from being discharged into the atmosphere during the stoppage of the internal combustion engine 2 or during the refueling of the fuel tank 16 and the regulation for checking the leakage of evaporative fuel by operating the first and second air cut valves 108 and 110, the tank pressure control valve 44, the purge valve 92, etc. can be observed.

Figure 10:
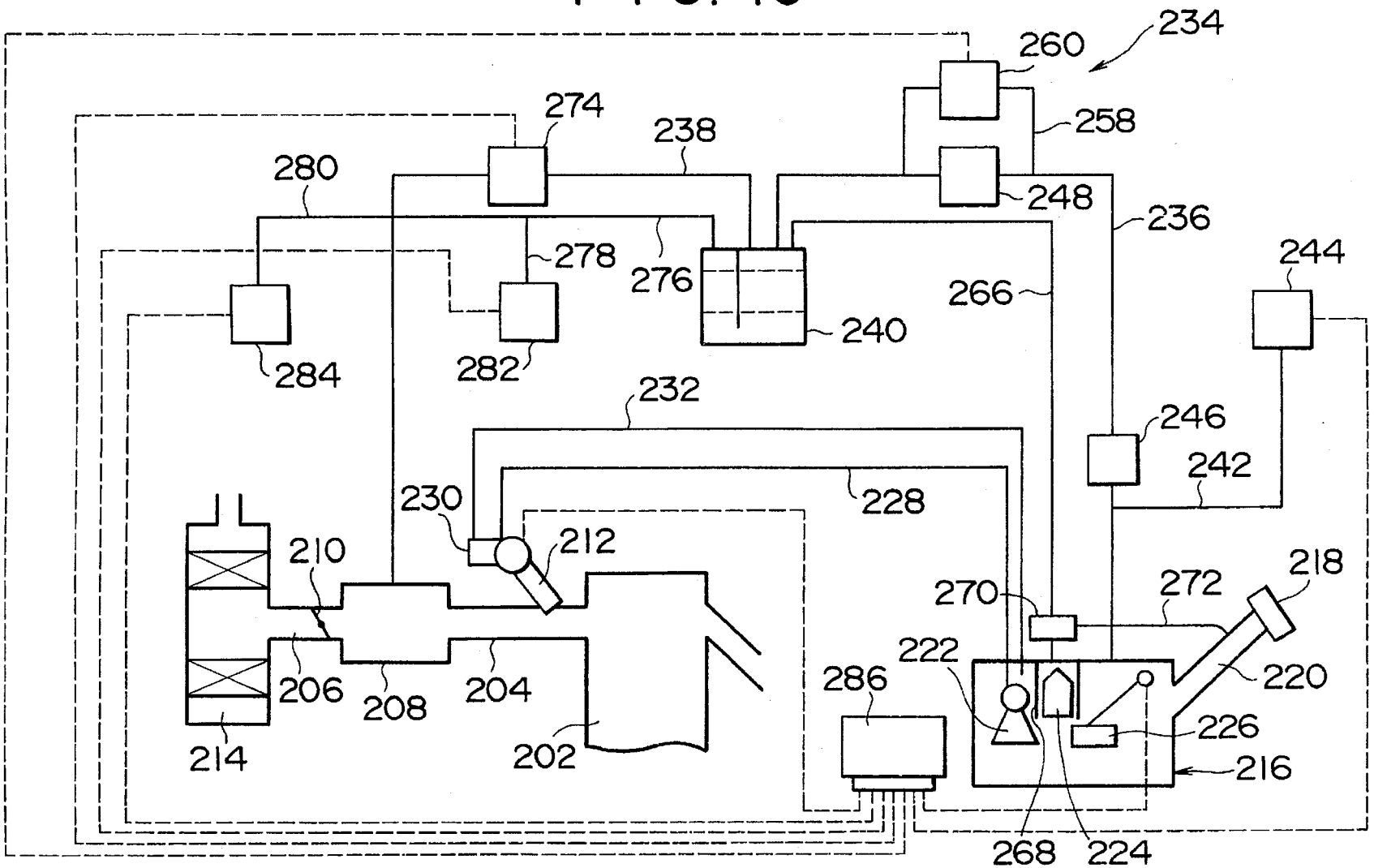
FIG. 10 is a schematic view of an evaporative fuel control system in accordance with a second embodiment of the present invention.

FIGS. 10 to 14 show a second embodiment of the present invention. In FIG. 10, reference numeral 202 denotes an internal combustion engine, 204 denotes an intake manifold, 206 denotes an intake passage, 208 denotes a surge tank, 210 denotes a throttle valve, 212 denotes a fuel injection valve, 214 denotes an air cleaner, and 216 denotes a fuel tank. To the fuel tank 216 is connected a fuel oil pipe 220 having a fuel oil cap 218. In the fuel tank 216 are provided a fuel pump 222, a float valve 224 moving vertically in accordance with the amount of fuel contained in the fuel tank 216, and a level gage 226 for detecting the amount of fuel. One end of a fuel supply line 228 is connected to the fuel pump 222. The other end of the fuel supply line 228 is connected to the fuel injection valve 212. The fuel injection valve 212 is provided with a fuel pressure regulating valve 230. One end of a fuel return line 232 is connected to the fuel pressure regulating valve 230. The other end of the fuel return line 232 is open to the fuel tank 216.

An evaporative fuel control system (evaporation system) 234 is provided between the fuel tank 216 and the intake system of the internal combustion engine 202.

Figure 11:
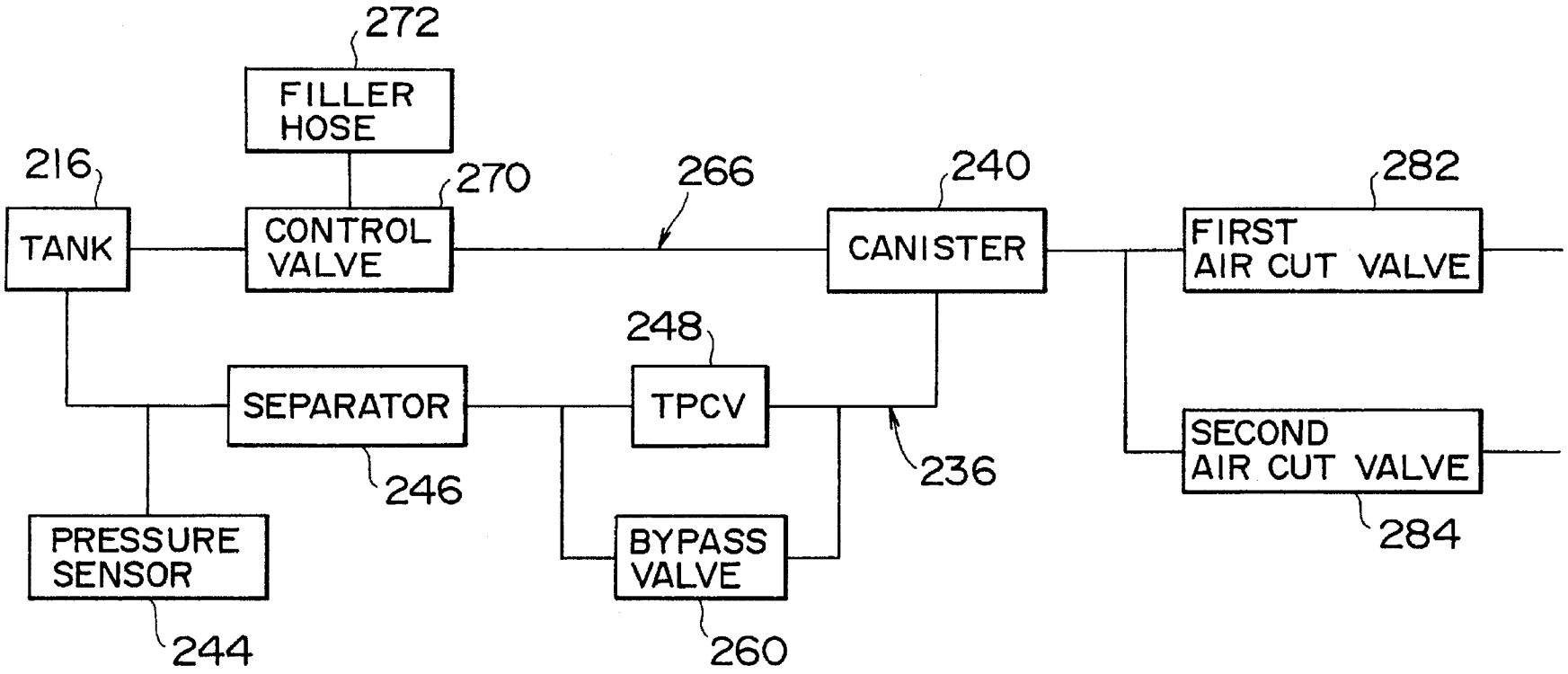
FIG. 11 is a block diagram of an evaporative fuel control system in accordance with a second embodiment of the present invention.

In the evaporative fuel control system 234, as shown in FIGS. 10 and 11, a canister 240 is installed between one end of an evaporation line 236 the other end of which is connected to the fuel tank 216 and one end of a purge line 238 the other end of which is connected to the surge tank 208 constituting the intake passage 206. One end of the evaporation line 236 and one end of the purge line 238 are open, side by side, to the upper part of the canister 240.

The canister 240 adsorbs the evaporative fuel generated in the fuel tank 216 and introduced into the evaporation line 236 during the stoppage of the internal combustion engine 202, and purges the adsorbed evaporative fuel by the introduction of air to supply the evaporative fuel to the intake passage 206 through the purge line 238 during the operation of the internal combustion engine 202.

At the intermediate position of the evaporation line 236, a pressure sensor 244, which is installed via a detection pressure line 242, a separator 246, and a tank pressure control valve (TPCV) 248, which is opened so as to open the evaporation line 236 when the tank pressure in the fuel tank 216 reaches a predetermined set pressure during the stoppage of the internal combustion engine 202, are provided in that order from the fuel tank 216 side.

Figure 12:
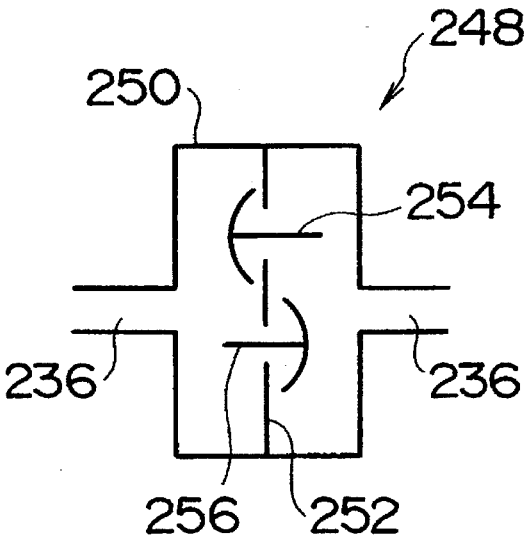
FIG. 12 is a schematic view of a tank pressure control valve of the second embodiment of the present invention.

The tank pressure control valve 248, as shown in FIG. 12, consists of a two-way valve, having a first and second check members 254 and 256 installed on a partition 252 in a housing 250.

A bypass line 258 is provided on the evaporation line 236 to bypass the tank pressure control valve 248. At the intermediate position of the bypass line 258, a bypass valve 260 (two-way solenoid valve) for opening/closing the bypass line 258 is installed.

Figure 13:
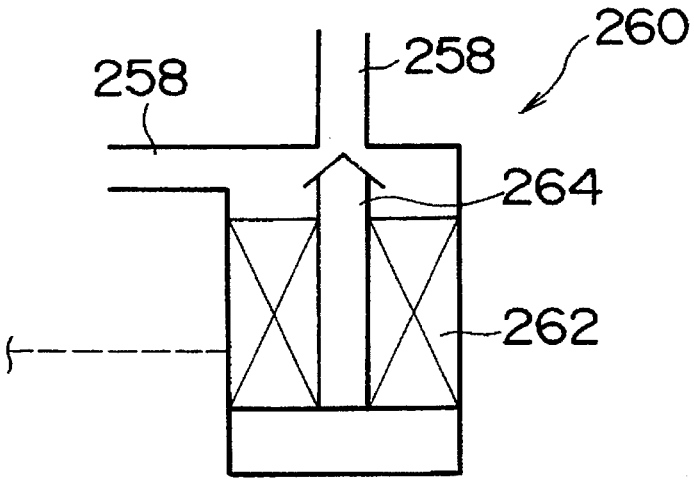
FIG. 13 is a schematic view of a bypass valve.

The bypass valve 260, as shown in FIG. 13, comprises a third solenoid 262 and a third valve element 264 for opening/closing the bypass line 258.

A communication line 266 is provided between the fuel tank 216 and the canister 240 to connect the fuel tank 216 to the canister 240.

The communication line 266 is connected to a float guide member 268 so as to be opened/closed by the float valve 224 moving vertically by being guided in the float guide member 268 in the fuel tank 216.

At the intermediate position of the communication line 266 is installed a control valve 270. The control valve 270 has the same configuration as that of the above-described first embodiment; therefore, the detailed explanation of the configuration is omitted. The control valve 270 is provided with a tank line 272 which is in communication with the fuel oil pipe 220.

At the intermediate position of the purge line 238, a purge valve 274 is installed to control the amount of evaporative fuel supplied to the intake passage 206 in accordance with the operation state of the internal combustion engine 202.

The canister 240 is provided with a plurality of atmosphere communication lines communicating with the atmosphere. An air cut valve is installed to each of these atmosphere communication lines. One end of a main atmosphere communication line 276 is connected to the canister 240. The other end of the main atmosphere communication line 276 branches into a first branch atmosphere communication line 278 and a second atmosphere communication line 280.

The first branch atmosphere communication line 278 is provided with a first air cut valve 282 which opens/closes so as to discharge air from the canister 240 into the atmosphere.

The second branch atmosphere communication line 280 is provided with a second air cut valve 284 which opens/closes so as to introduce air into the canister 240.

These first and second air cut valves 282 and 284 have the same configuration as that of the above-described first embodiment.

The other end of the first branch atmosphere communication line 278 is, though not shown, positioned above the fuel tank 216 mounted on a vehicle, as with the case of the above-described first embodiment.

The other end of the second branch atmosphere communication line 280 is, as with the case of the above-described first embodiment, positioned at a different place, any one of, for example, the air cleaner 214, and a frame, a trunk, and an air filter of the vehicle, none of which are shown, selectively.

The fuel injection valve 212, the level gage 226, the pressure sensor 244, the bypass valve 260, the purge valve 274, and the first and second air cut valves 282 and 284 are connected to a control section 286 which constitutes a control means.

The control section 286, receiving a signal from the level gage 226, the pressure sensor 244, or the like, operates the bypass valve 260 so as to open/close the evaporation line 236 during the operation of the internal combustion engine 202, and controls the amount of fuel injected into the internal combustion engine 202 by operating the fuel injection valve 212. Also, the control section 286 operates the purge valve 274, and in turn opens/closes the purge line 238, and moreover opens/closes the first and second branch atmosphere communication lines 278 and 280 by operating the first and second air cut valves 282 and 284, respectively.

Figure 14:
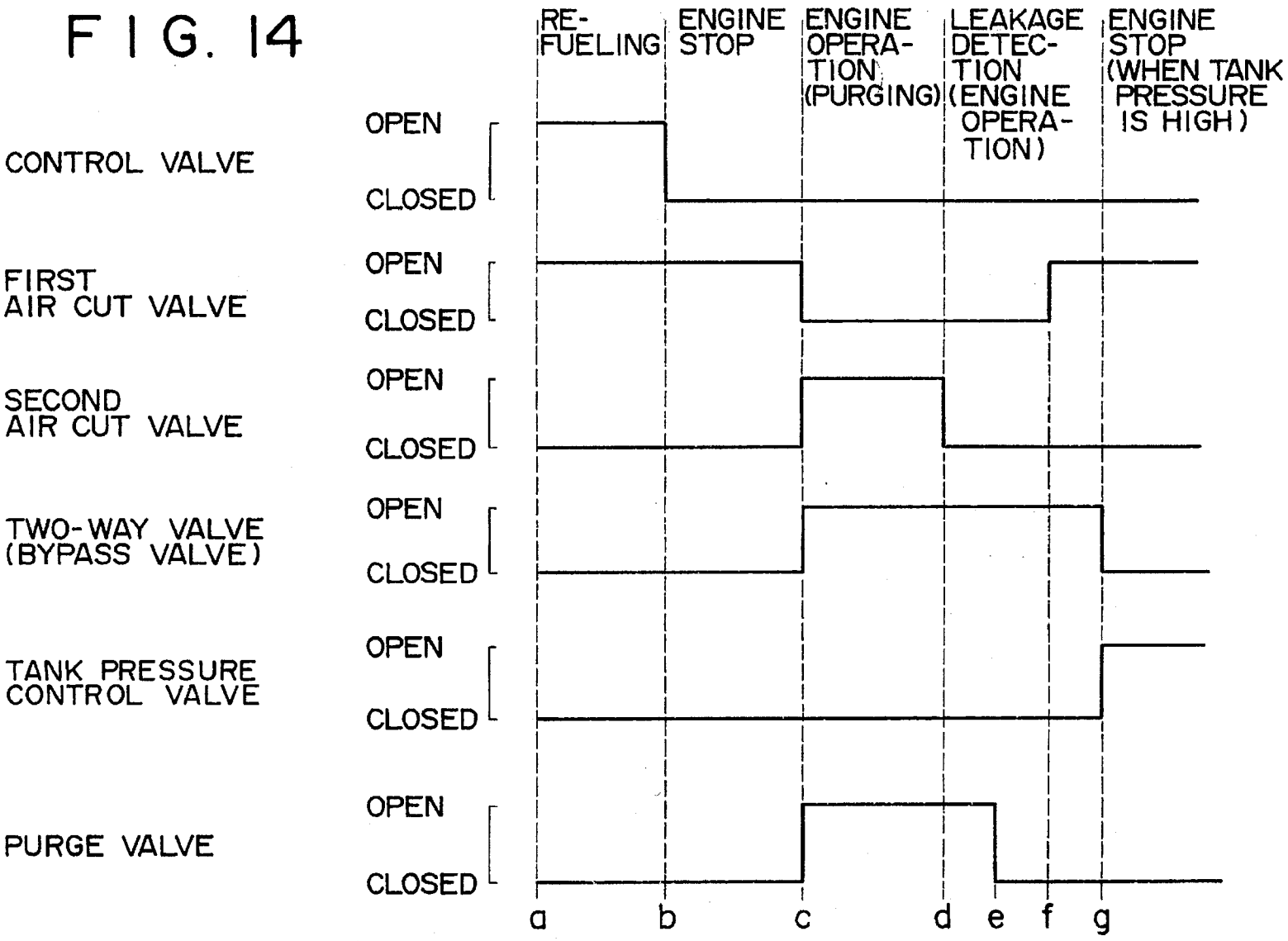
FIG. 14 is a time chart for evaporative fuel control in accordance with the second embodiment of the present invention.

Further, as shown in FIG. 14, the control section 286 makes different the opening/closing timing of the first and second air cut valves 282 and 284 during the operation of the internal combustion engine 202.

Next, the operation of the second embodiment will be described with reference to the time chart shown in FIG. 14.

During the refueling of the fuel tank 216 (shown by a to b in FIG. 14), a high tank pressure in the fuel tank 216 opens the control valve 270, and the first air cut valve 282 is open. Therefore, the evaporative fuel and air in the fuel tank 216 flow to the canister 240 side through the communication line 266, and the evaporative fuel generated in the fuel tank 216 is collected in the canister 240. On the other hand, the air contained in the evaporative fuel is discharged through the first branch atmosphere communication line 278, and the evaporative fuel is not discharged into the atmosphere.

When the internal combustion engine 202 is stopped and the tank pressure in the fuel tank 216 is low (shown by b to c in FIG. 14), the control valve 270 is closed, so that even when the first air cut valve 282 is opened, the evaporative fuel is not discharged into the atmosphere.

During the operation of the internal combustion engine 202, that is, when purge control is carried out (shown by c to d in FIG. 14), the purge valve 274 is opened, and the bypass valve 260, and in turn, the bypass line 258 are opened, so that the evaporation line 236 is opened. Also, the first air cut valve 282 is closed, and the second air cut valve 284 is opened.

Therefore, the air supplied through the second atmosphere communication line 280 is introduced into the canister 240 to purge the evaporative fuel in the canister 240, and the evaporative fuel generated in the fuel tank 216 is introduced into the canister 240 through the evaporation line 236, that is, evaporation control is carried out.

When the leakage of evaporative fuel is detected (shown by d to g in FIG. 14), the control valve 270 is opened, the tank pressure control valve 248 is closed, and the bypass valve 260 is opened. Also, the second air cut valve 284 is first closed with the first air cut valve 282 remaining closed (shown by d in FIG. 14). Then, the purge valve 274 is closed (shown by e in FIG. 14), and the first air cut valve 282 is opened (shown by f in FIG. 14). Thereupon, the leakage of evaporative fuel from the evaporative fuel control system 234 can be checked.

When the internal combustion engine 202 is stopped and the tank pressure in the fuel tank 216 is high (shown by g and after in FIG. 14), while the first air cut valve 282 is open, the bypass valve 260 is closed, and the tank pressure control valve 248 is opened. Thereupon, the evaporative fuel and air in the fuel tank 216 flow to the canister 240 side, the evaporative fuel is collected in the canister 240, and only air is discharged into the atmosphere.

The evaporative fuel control system 234 of the second embodiment can achieve the same effect as that of the above-described first embodiment.

Figure 15:
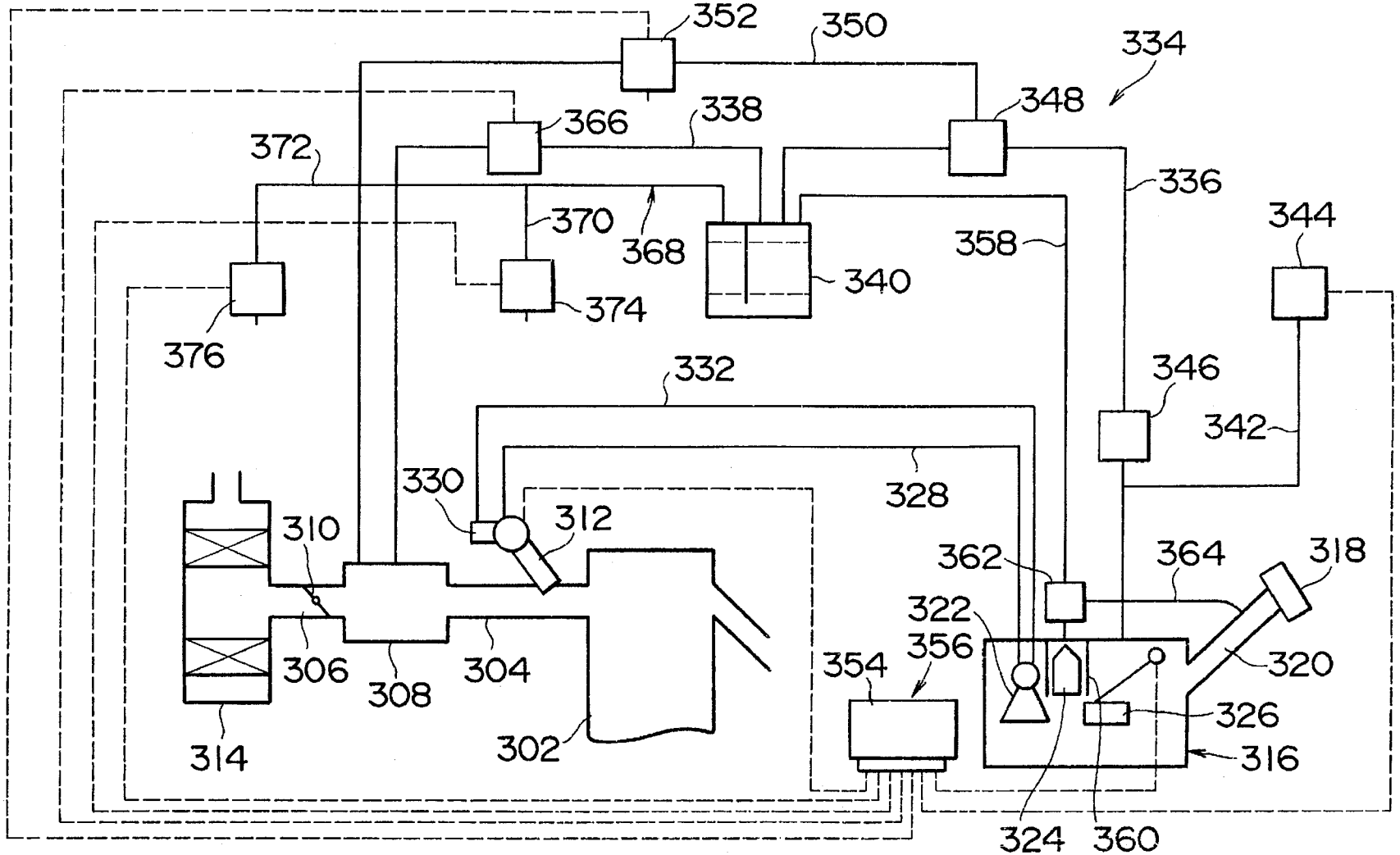
FIG. 15 is a schematic view of an evaporative fuel control system in accordance with a third embodiment of the present invention.
Figure 16:
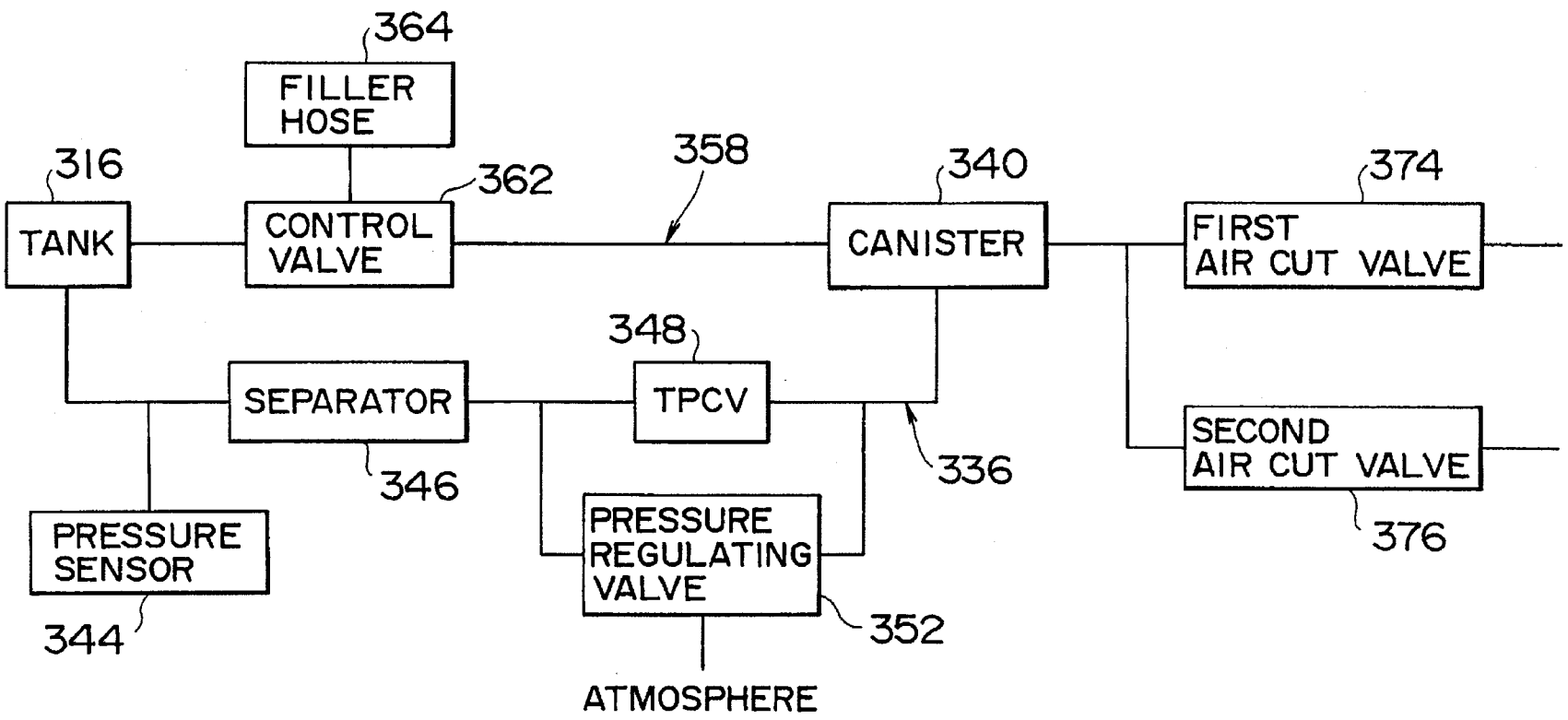
FIG. 16 is a block diagram of an evaporative fuel control system in accordance with a third embodiment of the present invention.
Figure 17:
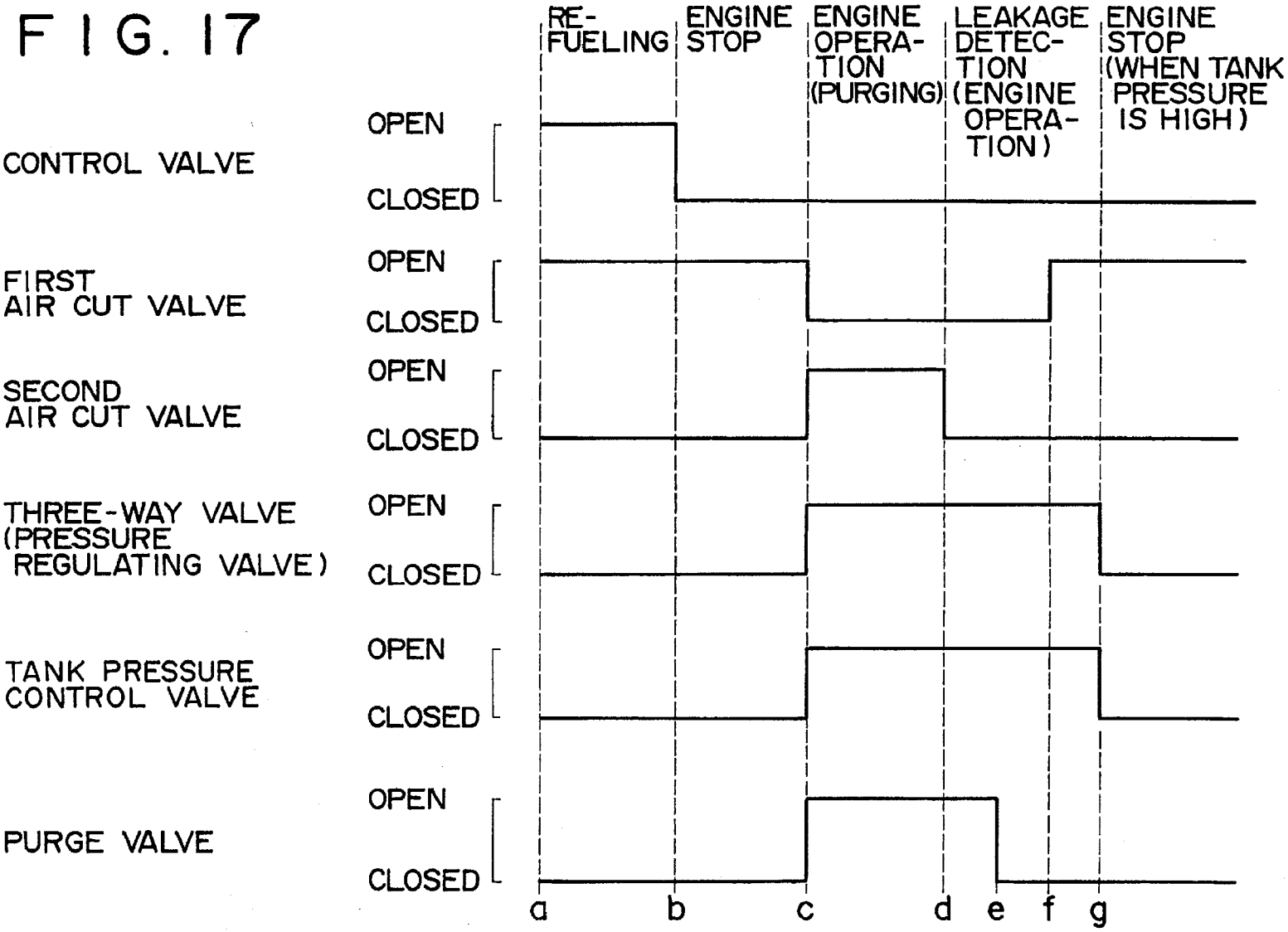
FIG. 17 is a time chart for evaporative fuel control in accordance with the third embodiment of the present invention.

FIGS. 15 to 17 show a third embodiment of the present invention. In FIG. 15, reference numeral 302 denotes an internal combustion engine, 304 denotes an intake manifold, 306 denotes an intake passage, 308 denotes a surge tank, 310 denotes a throttle valve, 312 denotes a fuel injection valve, 314 denotes an air cleaner, and 316 denotes a fuel tank. To the fuel tank 316 is connected a fuel oil pipe 320 having a fuel oil cap 318. In the fuel tank 316 are provided a fuel pump 322, a float valve 324, and a level gage 326 for detecting the amount of fuel. One end of a fuel supply line 328 is connected to the fuel pump 322. The other end of the fuel supply line 328 is connected to the fuel injection valve 312. The fuel injection valve 312 is provided with a fuel pressure regulating valve 330. One end of a fuel return line 332 is connected to the fuel pressure regulating valve 330. The other end of the fuel return line 332 is open to the fuel tank 316.

In the evaporative fuel control system 334, as shown in FIGS. 15 and 16, a canister 340 is installed between one end of an evaporation line 336 the other end of which is connected to the fuel tank 316 and one end of a purge line 338 the other end of which is connected to the surge tank 308 constituting the intake passage 306. One end of the evaporation line 336 and one end of the purge line 338 are open, side by side, to the upper part of the canister 340.

The canister 340 adsorbs the evaporative fuel generated in the fuel tank 316 and introduced into the evaporation line 336 during the stoppage of the internal combustion engine 302, and purges the adsorbed evaporative fuel by the introduction of air to supply the evaporative fuel to the intake passage 306 through the purge line 338 during the operation of the internal combustion engine 302.

At the intermediate position of the evaporation line 336, a pressure sensor 344, which is installed via a detection pressure line 342, a separator 346, and a tank pressure control valve (TPCV) 348, which is opened so as to open the evaporation line 336 when the tank pressure in the fuel tank 316 reaches a predetermined set pressure during the stoppage of the internal combustion engine 302, are provided in that order from the fuel tank 316 side.

The tank pressure control valve 348 has the same configuration as that of the tank pressure control valve of the first embodiment shown in FIG. 3; therefore, the explanation of the configuration is omitted.

The tank pressure control valve 348 is operated by a control means 356 consisting of a pressure line 350, a pressure regulating valve 352, and a control section 354, as with the case of the above-described first embodiment.

A communication line 358 is provided between the fuel tank 316 and the canister 340 to connect the fuel tank 316 to the canister 340.

The communication line 358 is connected to a float guide member 360 so as to be opened/closed by the float valve 324 moving vertically by being guided in the float guide member 360 in the fuel tank 316.

At the intermediate position of the communication line 358 is installed a control valve 362. The control valve 362 has the same configuration as that of the control valve of the first embodiment shown in FIG. 4; therefore, the detailed explanation of the configuration is omitted. The control valve 362 is provided with a tank line 364 which is in communication with the fuel oil pipe 320.

At the intermediate position of the purge line 338, a purge valve 366 is installed to control the amount of evaporative fuel supplied to the intake passage 306 in accordance with the operation state of the internal combustion engine 302. The purge valve 366 has the same configuration as that of the above-described first embodiment.

The canister 340 is provided with a plurality of atmosphere communication lines communicating with the atmosphere. An air cut valve is installed to each of these atmosphere communication lines. One end of a main atmosphere communication line 368 is connected to the canister 340. The other end of the main atmosphere communication line 368 branches into a first branch atmosphere communication line 370 and a second atmosphere communication line 372.

The first branch atmosphere communication line 370 is provided with a first air cut valve 374 which opens/closes so as to discharge air from the canister 340 into the atmosphere.

The second branch atmosphere communication line 372 is provided with a second air cut valve 376 which opens/closes so as to introduce air into the canister 340.

These first and second air cut valves 374 and 376 have the same configuration as that of the above-described first embodiment.

The other end of the first branch atmosphere communication line 370 is, though not shown, positioned above the fuel tank 316 mounted on a vehicle, as with the case of the above-described first embodiment.

The other end of the second branch atmosphere communication line 372 is, as with the case of the above-described first embodiment, positioned at a different place, any one of, for example, the air cleaner 314, and a frame, a trunk, and an air filter of the vehicle, none of which are shown, selectively.

The fuel injection valve 312, the level gage 326, the pressure sensor 344, the purge valve 366, and the first and second air cut valves 374 and 376 are connected to the control section 354.

The control section 354, receiving a signal from the level gage 326, the pressure sensor 344, or the like, operates the pressure regulating valve 352 so as to open/close the evaporation line 336 during the operation of the internal combustion engine 302, and controls the amount of fuel injected into the internal combustion engine 302 by operating the fuel injection valve 312. Also, the control section 354 operates the purge valve 366, and in turn opens/closes the purge line 338, and moreover opens/closes the first and second branch atmosphere communication lines 370 and 372 by operating the first and second air cut valves 374 and 376, respectively.

Further, as shown in FIG. 17, the control section 354 makes different the opening/closing timing of the first and second air cut valves 374 and 376.

Next, the operation of the third embodiment will be described with reference to the time chart shown in FIG. 17.

During the refueling of the fuel tank 316 (shown by a to b in FIG. 17), the tank pressure in the fuel tank 316 opens the control valve 362, and the first air cut valve 372 is open. Therefore, the evaporative fuel and air in the fuel tank 316 flow to the canister 240 side through the communication line 358, and the evaporative fuel is collected in the canister 340. On the other hand, the air is discharged through the first branch atmosphere communication line 370, and the evaporative fuel is not discharged into the atmosphere.

When the internal combustion engine 302 is stopped and the tank pressure in the fuel tank 316 is low (shown by b to c in FIG. 17), the control valve 362 is closed, so that even when the first air cut valve 374 is opened, the evaporative fuel is not discharged into the atmosphere.

During the operation of the internal combustion engine 302, that is, when purge control is carried out (shown by c to d in FIG. 17), the purge valve 366 is opened, and the pressure regulating valve 352 is opened, so that the evaporation line 336 is opened. Also, the first air cut valve 374 is closed, and the second air cut valve 376 is opened.

Therefore, the air supplied through the second atmosphere communication line 372 is introduced into the canister 340 to purge the evaporative fuel in the canister 340, and the evaporative fuel in the fuel tank 316 is introduced into the canister 340 through the evaporation line 336, that is, evaporation control is carried out.

When the leakage of evaporative fuel is detected (shown by d to g in FIG. 17), the control valve 362 is opened, the first air cut valve 374 is closed, the pressure regulating valve 352 is opened, and the tank pressure control valve 348 is opened. Also, the second air cut valve 376 is first closed with the purge valve 366 remaining opened (shown by d in FIG. 17). Then, the purge valve 366 is closed (shown by e in FIG. 17), and the first air cut valve 374 is opened (shown by f in FIG. 17). Thereupon, the leakage of evaporative fuel from the evaporative fuel control system 334 can be checked.

When the internal combustion engine 302 is stopped and the tank pressure in the fuel tank 316 is high (shown by g and after in FIG. 17), while the first air cut valve 374 is open, the pressure regulating valve 352 is closed, and the tank pressure control valve 348 is closed. Thereupon, even if the evaporative fuel and air in the fuel tank 316 flow to the canister 340 side, the evaporative fuel is collected in the canister 340, and only air is discharged into the atmosphere.

The evaporative fuel control system 334 of the third embodiment can achieve the same effect as that of the above-described first embodiments.

Figure 18:
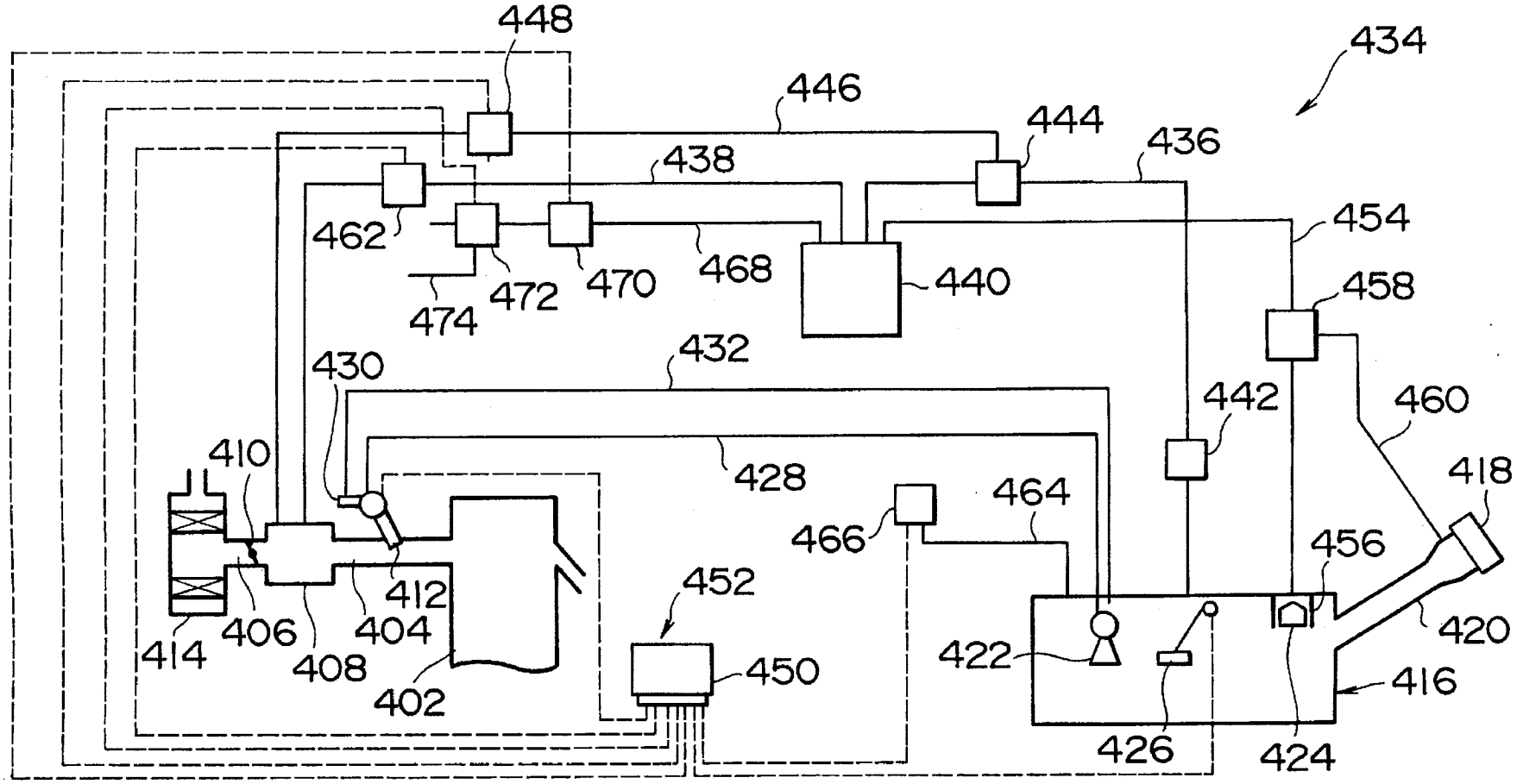
FIG. 18 is a schematic view of an evaporative fuel control system in accordance with a fourth embodiment of the present invention.

FIGS. 18 to 21 show a fourth embodiment of the present invention. In FIG. 18, reference numeral 402 denotes an internal combustion engine, 404 denotes an intake manifold, 406 denotes an intake passage, 408 denotes a surge tank, 410 denotes a throttle valve, 412 denotes a fuel injection valve, 414 denotes an air cleaner, and 416 denotes a fuel tank. To the fuel tank 416 is connected a fuel oil pipe 420 having a fuel oil cap 418. In the fuel tank 416 are provided a fuel pump 422, a float valve 424 moving vertically in accordance with the amount of fuel contained in the fuel tank 416, and a level gage 426 for detecting the amount of fuel. One end of a fuel supply line 428 is connected to the fuel pump 422. The other end of the fuel supply line 428 is connected to the fuel injection valve 412. The fuel injection valve 412 is provided with a fuel pressure regulating valve 430. One end of a fuel return line 432 is connected to the fuel pressure regulating valve 430. The other end of the fuel return line 432 is open to the fuel tank 416.

An evaporative fuel control system (evaporation system) 434 is provided between the fuel tank 416 and the intake system of the internal combustion engine 402.

Figure 19:
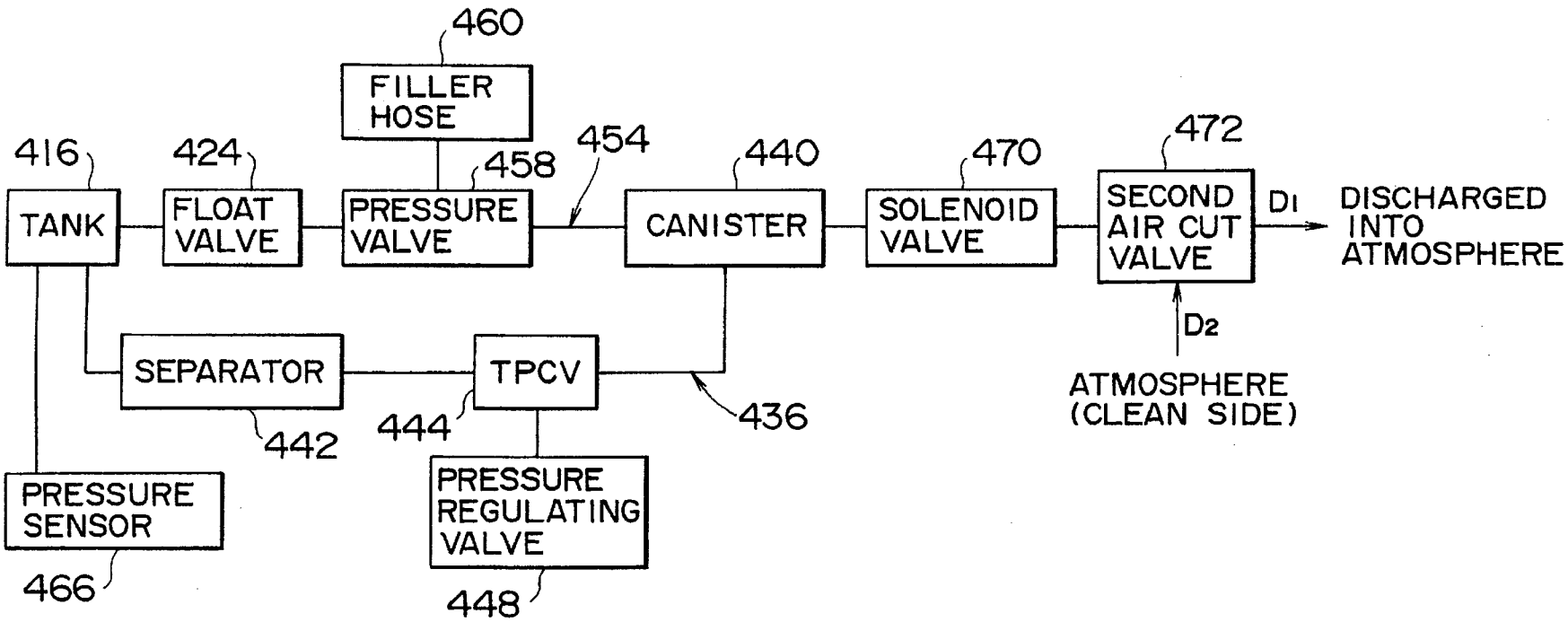
FIG. 19 is a block diagram of an evaporative fuel control system in accordance with a fourth embodiment of the present invention.

In the evaporative fuel control system 434, as shown in FIGS. 18 and 19, a canister 440 is installed between one end of an evaporation line 436 the other end of which is connected to the fuel tank 416 and one end of a purge line 438 the other end of which is connected to the surge tank 408 constituting the intake passage 406. One end of the evaporation line 436 and one end of the purge line 438 are open, side by side, to the upper part of the canister 440.

The canister 440 adsorbs the evaporative fuel generated in the fuel tank 416 and introduced into the evaporation line 436 during the stoppage of the internal combustion engine 402, and purges the adsorbed evaporative fuel by the introduction of air to supply the evaporative fuel to the intake passage 406 through the purge line 438 during the operation of the internal combustion engine 402.

At the intermediate position of the evaporation line 436, a separator 442 and a tank pressure control valve (TPCV) 444, which is opened so as to open the evaporation line 436 when the tank pressure in the fuel tank 416 reaches a predetermined set pressure during the stoppage of the internal combustion engine 402, are provided in that order from the fuel tank 416 side.

The tank pressure control valve 444 is operated by a control means 452 consisting of a pressure line 446, a pressure regulating valve 448, and a control section 450, as with the case of the above-described first embodiment.

A communication line 454 is provided between the fuel tank 416 and the canister 440 to connect the fuel tank 416 to the canister 440.

The communication line 454 is connected to a float guide member 456 so as to be opened/closed by the float valve 424 moving vertically by being guided in the float guide member 456 in the fuel tank 416.

At the intermediate position of the communication line 454 is installed a control valve 458. The control valve 458 has the same configuration as that of the control valve of the first embodiment shown in FIG. 4; therefore, the detailed explanation of the configuration is omitted. The control valve 458 is provided with a tank line 460 which is in communication with the fuel oil pipe 420.

At the intermediate position of the purge line 438, a purge valve 462 is installed to control the amount of evaporative fuel supplied to the intake passage 406 in accordance with the operation state of the internal combustion engine 402.

One end of a detection pressure line 464 is connected to the fuel tank 416. At the other end of the detection pressure line 464 is installed a pressure sensor 466 for detecting the tank pressure in the fuel tank 416.

The canister 440 is provided with one atmosphere communication line 468 communicating with the atmosphere. In the atmosphere communication line 468, a first air cut valve 470 (two-way solenoid valve) and a second air cut valve 472 (three-way solenoid valve) are provided in series as a plurality of air cut valves.

The first air cut valve 470 has the same configuration as that of the purge valve of the first embodiment; therefore, the explanation of the configuration is omitted. Also, the second air cut valve 472 has the same configuration as that of the pressure regulating valve of the first embodiment; therefore, the explanation of the configuration is omitted.

The first air cut valve 470 opens/closes the atmosphere communication line 468.

The second air cut valve 472 discharges the air from the canister 440, and introduces air into the canister 440 through an atmosphere introduction line 474.

Figure 20:
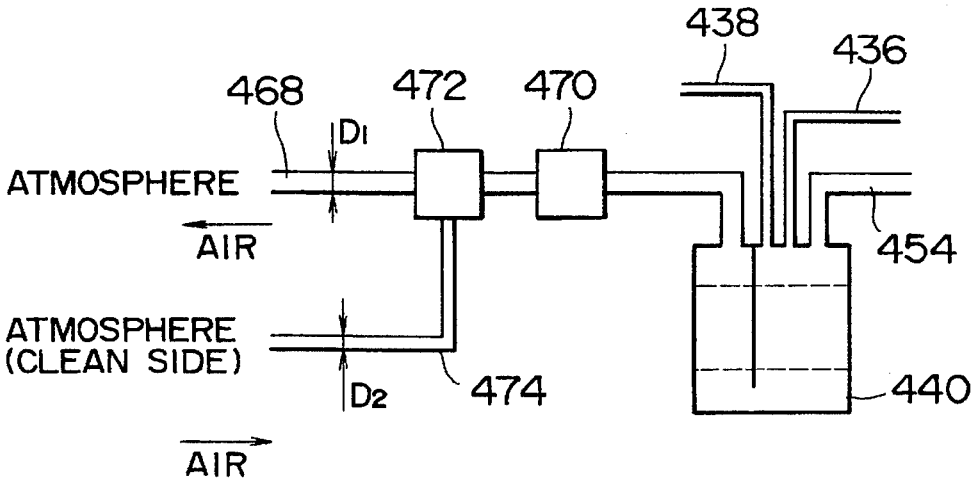
FIG. 20 is an enlarged schematic view of the main part of the atmosphere side of a canister.

As shown in FIG. 20, a first diameter $D_1$ of the atmosphere communication line 468 is larger than a second diameter $D_2$ of the atmosphere introduction line 474.

The fuel injection valve 412, the level gage 426, the pressure regulating valve 448, the purge valve 462, the pressure sensor 466, and the first and second air cut valves 470 and 472 are connected to a control section 450.

The control section 450, receiving a signal from the level gage 426, the pressure sensor 466, or the like, operates the pressure regulating valve 448 so as to open/close the evaporation line 436 during the operation of the internal combustion engine 402, and controls the amount of fuel injected into the internal combustion engine 402 by operating the fuel injection valve 412. Also, the control section 450 operates the purge valve 462, and in turn opens/closes the purge line 438, and moreover opens/closes the atmosphere communication lines 468 by operating the first and second air cut valves 470 and 472.

Figure 21:
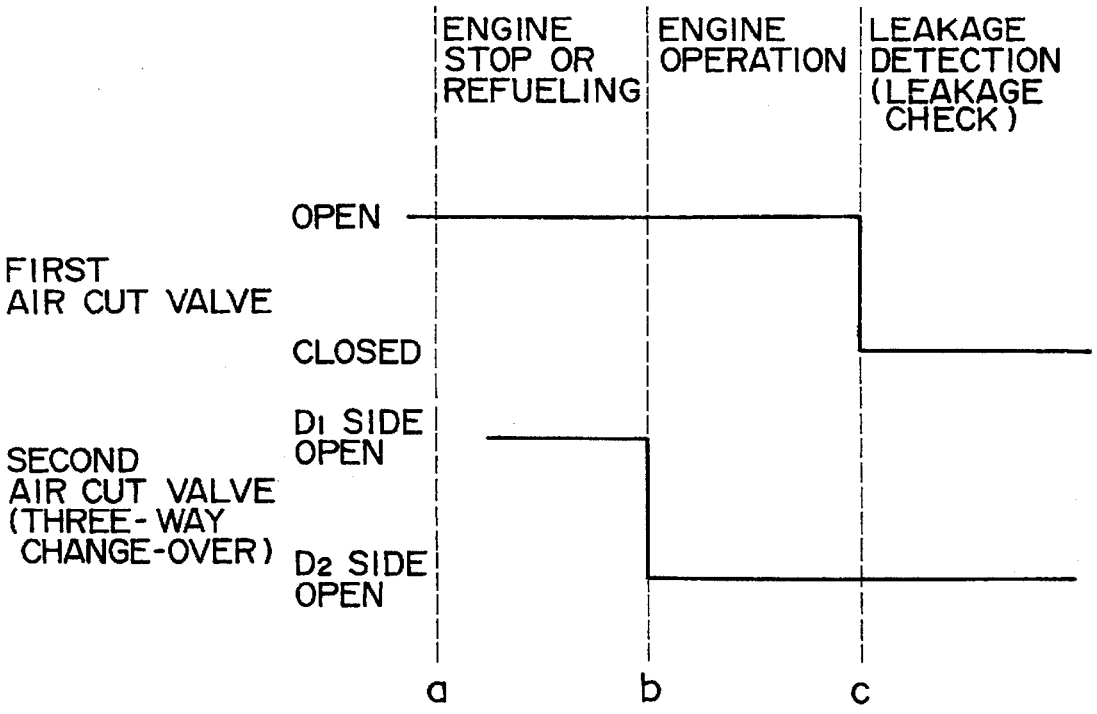
FIG. 21 is a time chart for evaporative fuel control in accordance with the fourth embodiment of the present invention.

Further, as shown in FIG. 21, the control section 450 makes different the opening/closing timing of the first and second air cut valves 470 and 472 during the operation of the internal combustion engine 402.

Next, the operation of the fourth embodiment will be described with reference to the time chart shown in FIG. 21.

The tank pressure control valve 444 and the control valve 458 function in the same manner as those of the first embodiment.

When the internal combustion engine 402 is stopped, or when fuel oil is fed into the fuel tank 416, the first air cut valve 470 is open and the atmosphere introduction line 474 is closed by the second air cut valve 472 (shown by a to b in FIG. 21).

Therefore, when the tank pressure in the fuel tank 416 becomes high and the evaporative fuel and air reach the canister 440, the evaporative fuel is collected in the canister 440, and on the other hand, only air is discharged into the atmosphere through the atmosphere communication line 468.

During the operation of the internal combustion engine 402, the first air cut valve 470 is open, and on the other hand, the atmosphere introduction line 474 is opened by the second air cut valve 472 (shown by b to c in FIG. 21).

Therefore, air is introduced into the canister 440 through the atmosphere introduction line 474 and the atmosphere communication line 468, whereby the evaporative fuel in the canister 440 is purged and supplied to the intake passage 406 through the purge line 436.

When the leakage of evaporative fuel from the evaporative fuel control system 434 is checked, the first and second air cut valves 470 and 472 are closed (shown by c and after in FIG. 21).

As a result, since the evaporative fuel is collected in the canister 440 and only air is discharged into the atmosphere during the stoppage of the internal combustion engine 402 or the refueling of the fuel tank 416, air pollution can be prevented.

Also, since the atmosphere communication line 468 can be switched by two air cut valves during the stoppage of the internal combustion engine 402 or the refueling of the fuel tank 416, the check of leakage of evaporative fuel can be made advantageously.

Also, since the opening/closing timing of the first and second air cut valves 470 and 472 is made different, the discharge of air from the canister 440 and the introduction of air into the canister 440 can be performed smoothly.

The evaporative fuel control system 434 of the fourth embodiment can achieve the same effect as that of the above-described first embodiments.

As seen from the above detailed description, according to the present invention, the canister is provided with a plurality of air communication lines communicating with the atmosphere side, an air cut valve is installed in each of the atmosphere communication lines, and a control means is provided to control the operation of the air cut valve. Thereby, during the stoppage of the internal combustion engine or the refueling of the fuel tank, the evaporative fuel is collected in the canister, and then only the air contained in the evaporative fuel can be discharged into the atmosphere, so that air pollution can be prevented, the clogging of the canister due to sewage or freezing on the atmosphere side can be prevented, and further the contamination of the atmosphere communication line and the clogging of the canister due to suction air can be prevented.

I claim:

1. An evaporative fuel control system for an internal combustion engine comprising:

a canister, installed between an evaporation line communicating with a fuel tank and a purge line communicating with an intake passage of the intake system of said internal combustion engine, said canister and evaporation line defining an evaporative fuel delivery path for introducing evaporative fuel into said canister for absorbing evaporative fuel generated in the fuel tank during stoppage of said internal combustion engine, and said canister and said purge line defining a purge delivery path for purging absorbed evaporative fuel by the introduction of air to deliver the evaporative fuel to said intake passage through said purge line during operation of said internal combustion engine;

a purge valve, installed at the intermediate position of said purge line, for controlling the amount of evaporative fuel supplied to said intake passage in accordance with the operation state of said internal combustion engine;

an atmosphere communication line in communication with said canister and the atmosphere;

a plurality of air cut valves are installed in series in said atmosphere communication line, wherein said plurality of air cut valves comprises a first air cut valve and a second air cut valve, said first air cut valve first disposed along said atmosphere communication line after said canister defining an open position and a closed position, said open position corresponding to an open communication path between said canister and the atmosphere allowing communication between said canister and the atmosphere along said atmosphere communication path, said closed position corresponding to a closed communication path preventing communication between the atmosphere and said canister along said atmosphere communication path, said second air cut valve defining a first position and a second position, said first position directing air from the atmosphere into said atmosphere communication line, said second position directing air from the communication path out of said atmosphere communication line; and control means is provided to control the operation of said first air cut valve so as to open and close said atmosphere communication line and to control the operation of said second air cut valve separated from said canister so as to discharge air from said canister into the atmosphere and introduce air into said canister.

2. An evaporative fuel control system according to claim 1, wherein said control means responsive to a leak-check input modality directs said first air-cut valve to a closed position.

3. An evaporative fuel control system according to claim 1, further comprising:

a fuel tank line in communication with said canister and a fuel oil pipe of said fuel tank; and a control valve operably associated with said fuel tank line responsive to said fuel tank level to contain and direct the flow of evaporative fuel during refueling, thereby minimizing environmental discharge of evaporative fuel from a fuel tank through a breather pipe during refueling.

4. An evaporative fuel control system according to claim 1, said atmosphere communication line having a diameter $D_1$, said evaporative fuel control system further comprising an air introduction line having a diameter less than $D_1$ disposed on said second air-cut valve in communication with said atmosphere communication line.

5. An evaporative fuel control system for an internal combustion engine, comprising:

a canister positioned between an evaporation line communicating with a fuel tank and a purge line communicating with an intake passage of the intake system of said internal combustion engine, said canister and evaporation line defining an evaporative fuel delivery path for introducing evaporative fuel into said canister for absorbing evaporative fuel generated in the fuel tank during stoppage of said internal combustion engine, and said canister and said purge line defining a purge delivery path for purging absorbed evaporative fuel by the introduction of air to deliver the evaporative fuel to said intake passage through said purge line during operation of said internal combustion engine;

a purge valve positioned in said purge line intermediate of said canister and said engine intake passage for controlling the amount of evaporative fuel supplied to said intake passage responsive to predetermined engine operating conditions of said internal combustion engine;

a plurality of atmosphere communication lines in communication with said canister and the atmosphere, each of said atmosphere communication lines having an air cut valve positioned therein, wherein at least one of said air cut valves is configured for releasing air from said canister into the atmosphere while at least another one of said air cut valves in another of said atmosphere communication lines is configured for introducing air into said canister, and wherein said air release communication line has a first diameter and said air introduction communication line has a second diameter smaller than said first diameter; and a control means operably associated with each of said air cut valves for controlling the operation of said air cut valves in said atmosphere communication lines responsive to predetermined engine operating conditions.

6. An evaporative fuel control system according to claim 5, wherein said control means responsive to a leak-check input modality directs said air-cut valves in each of said release and introduction atmosphere communication lines to close.

7. An evaporative fuel control system according to claim 5, further comprising:

a fuel tank line in communication with said canister and a fuel oil pipe of said fuel tank; and a control valve operably associated with said fuel tank line responsive to said fuel tank level to contain and direct the flow of evaporative fuel during refueling, thereby minimizing environmental discharge of evaporative fuel from a fuel tank through a breather pipe during refueling.

8. An evaporative fuel control system according to claim 5, wherein said plurality of atmosphere communication lines includes a main atmosphere communication line connected to said canister, said main atmosphere communication line having a main diameter and configured to branch at an end remote from said canister directly into two separate atmosphere communication lines:

a first atmosphere introduction communication line having a first end, a second end remote from said main line, and a diameter substantially equal to said main diameter, said second end positioned adjacent one of an air cleaner, a vehicle frame, a vehicle trunk and an air filter positioned on the vehicle body;

a second atmosphere discharge communication line having a first end, a second end remote from said main line, and a diameter less than the main diameter, said second end positioned adjacent said fuel tank;

a first air-cut valve positioned adjacent said first end of said first atmosphere line operably associated with said control means to direct air associated with said evaporative fuel to be discharged away from the interior of a vehicle; and a second air-cut valve positioned adjacent said first end of said second atmosphere line operably associated with said control means to direct air which is substantially free of debris into said evaporative fuel system thereby minimizing air induced clogging of said evaporative fuel system.

9. An evaporative fuel control system for an internal combustion engine according to claim 5, wherein the tip end of one of said atmosphere communication lines for releasing air from said canister into the atmosphere is connected to a different place so as to introduce said air to a safe place during the refueling of said fuel tank.

10. An evaporative fuel control system for an internal combustion engine according to claim 5, wherein the opening/closing timing of one of said air cut valves operation to discharge air from said canister into the atmosphere and the other of said air cut valves operating to introduce air into said canister is made different.

* * * * *

UNITED STATES PATENT AND TRADEMARK OFFICE

CERTIFICATE OF CORRECTION

PATENT NO. : 5,647,333

DATED : July 15, 1997

INVENTOR(S) : Mukai

It is certified that error appears in the above-identified patent and that said Letters Patent is hereby corrected as shown below:

Column 1, delete lines 24-48.

Column 2, line 16, "liner" should be --line--.

Column 2, delete lines 24-28.

Column 8, line 38, "caster" should be --canister--.

Column 8, line 45, "caster" should be --canister--.

Column 9, line 54, after "having" omit "a".

Figure 22:
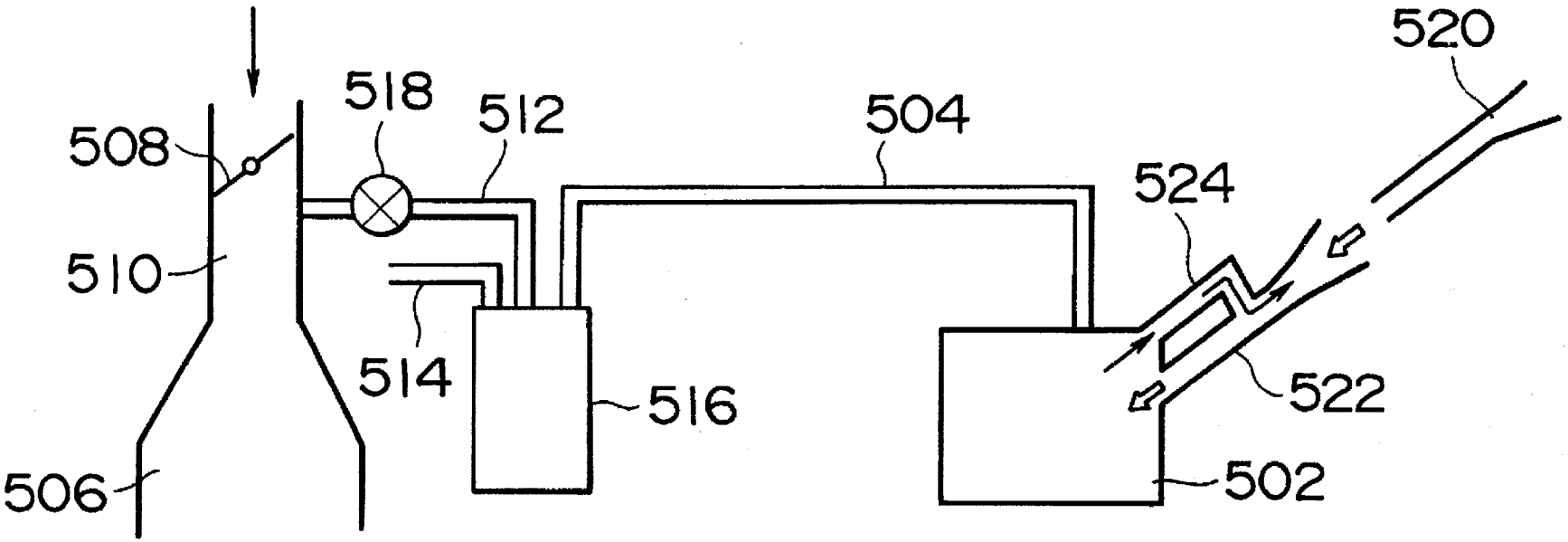
FIG. 22 RELATED ART
FIG. 22 is a schematic view of a conventional evaporative fuel control system.

Column 16, after line 36, insert the following:

-- In this evaporative fuel control system, as shown in FIG. 22, a canister 516 is provided between an evaporation line 504 communicating with a fuel tank 502 and a purge line 512 which is an intake system for an internal combustion engine 506 and in communication with an intake passage 510 on the downstream side of a throttle valve 508. The canister 516 absorbs evaporative fuel, which is generated in the fuel tank 502 and introduced to the evaporation line 504 during the stoppage of the internal combustion engine 506, and purges the adsorbed evaporative fuel by means of air

UNITED STATES PATENT AND TRADEMARK OFFICE

CERTIFICATE OF CORRECTION

PATENT NO. : 5,647,333

DATED : July 15, 1997

INVENTOR(S) : Mukai

It is certified that error appears in the above-identified patent and that said Letters Patent is hereby corrected as shown below:

introduced from an atmosphere communication line 514 to supply it to the intake passage 510 through the purge line 512 during the operation of the internal combustion engine 506. At an intermediate position of the purge line 512 is installed a purge valve (two-way solenoid valve) 518 for controlling the amount of evaporative fuel supplied to the intake passage 510 in accordance with the operation state of the internal combustion engine 506. The purge valve 518 undergoes duty control by using a control section (ECM) (not shown).

The fuel tank 502 is provided with a fuel oil pipe 522 for pouring fuel from a fuel oil gun 520. Also, the fuel tank 502 has a breather pipe 524 for connecting the upper part of the fuel tank 502 to the intermediate position of the fuel oil pipe 522.

UNITED STATES PATENT AND TRADEMARK OFFICE

CERTIFICATE OF CORRECTION

PATENT NO. : 5,647,333

DATED : July 15, 1997

INVENTOR(S) : Mukai

It is certified that error appears in the above-identified patent and that said Letters Patent is hereby corrected as shown below:

In the evaporative fuel control system shown in FIG. 22, however, the evaporative fuel generated in the fuel tank 502 is discharged into the atmosphere through the breather pipe 524 at the refueling time when fuel is poured into the fuel tank 502, resulting in air pollution.--

Signed and Sealed this

Tenth Day of March, 1998

*Attest:*

*Attesting Officer*

BRUCE LEHMAN

*Commissioner of Patents and Trademarks*